US010199719B2

(12) United States Patent
Kim et al.

(10) Patent No.: US 10,199,719 B2
(45) Date of Patent: Feb. 5, 2019

(54) ANTENNA AND ELECTRONIC DEVICE HAVING THE SAME

(71) Applicant: Samsung Electronics Co., Ltd., Suwon-si, Gyeonggi-do (KR)

(72) Inventors: Yeonwoo Kim, Suwon-si (KR); Seunggil Jeon, Suwon-si (KR); Jung-Sik Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 186 days.

(21) Appl. No.: 15/013,496

(22) Filed: Feb. 2, 2016

(65) Prior Publication Data

US 2016/0226132 A1 Aug. 4, 2016

(30) Foreign Application Priority Data

Feb. 2, 2015 (KR) ..... 10-2015-0016266

(51) Int. Cl.

| | |
|---|---|
| ***H01Q 1/24*** | (2006.01) |
| ***H01Q 1/48*** | (2006.01) |
| ***H01Q 5/378*** | (2015.01) |
| *H01Q 21/30* | (2006.01) |

(52) U.S. Cl.

CPC ..... *H01Q 1/243* (2013.01); *H01Q 1/48* (2013.01); *H01Q 5/378* (2015.01); *H01Q 21/30* (2013.01)

(58) Field of Classification Search

CPC ..... H01Q 1/243; H01Q 5/378; H01Q 1/48; H01Q 21/30

See application file for complete search history.

(56) References Cited

U.S. PATENT DOCUMENTS

| | | | | |
|---|---|---|---|---|
| 2009/0167631 | A1 | 7/2009 | Tai et al. | |
| 2012/0044114 | A1 | 2/2012 | Eom et al. | |
| 2012/0098709 | A1 | 4/2012 | Chun et al. | |
| 2012/0105287 | A1 | 5/2012 | Jung et al. | |
| 2012/0178382 | A1 | 7/2012 | Merz et al. | |
| 2014/0292589 | A1 | 10/2014 | Park et al. | |
| 2014/0292590 | A1* | 10/2014 | Yoo | H01Q 1/243 343/702 |
| 2014/0313098 | A1 | 10/2014 | Lin | |
| 2014/0333488 | A1 | 11/2014 | Wang et al. | |

FOREIGN PATENT DOCUMENTS

| | | | |
|---|---|---|---|
| JP | 2012227850 | A | 11/2012 |
| KR | 10-2013-0115319 | A | 10/2013 |

* cited by examiner

*Primary Examiner* — Graham Smith

(74) *Attorney, Agent, or Firm* — Jefferson IP Law, LLP

(57) ABSTRACT

An antenna of an electronic device is provided. The antenna includes a substrate including a ground portion, an external metallic frame of the electronic device, a float ground portion arranged to be connected to the external metallic frame in a state of being disconnected from the substrate, and at least one radiator electrically connected to the float ground portion. Upon being fed with power, the at least one radiator may operate as an antenna radiator, or a section of the external metallic frame may operate as the antenna radiator.

20 Claims, 43 Drawing Sheets

ANTENNA AND ELECTRONIC DEVICE HAVING THE SAME

CROSS-REFERENCE TO RELATED APPLICATION(S)

This application claims the benefit under 35 U.S.C. § 119(a) of a Korean patent application filed on Feb. 2, 2015 in the Korean Intellectual Property Office and assigned Serial number 10-2015-0016266, the entire disclosure of which is hereby incorporated by reference.

TECHNICAL FIELD

The present disclosure relates to a technique related to an antenna.

BACKGROUND

It has been requested that electronic devices, which have a communication function, have a function that may be provided with mobile communication services of different frequency bands using a single electronic device while being reduced in size and weight.

In order to satisfy the request, for example, a metal device antenna (MDA) and a bezel antenna have been proposed. The MDA uses a metallic mechanical product as a radiator, and the bezel antenna uses a metallic housing as a radiator.

Currently, applying an external metal frame structure has become a design trend in electronic devices, and demand for the electronic devices following the trend has increased. As metallic frame structures have been applied to the external cases of electronic devices, the problem of antenna radiation performance degradation has also grown serious. Although antennas are designed to avoid or to be spaced apart from a metallic structure in order to overcome this problem, it is practically difficult to overcome the performance degradation problem as an antenna mounting space is narrowed as a metallic frame structure is applied.

In addition, with the advancement of communication technologies, frequency bands, which shall be supported by the electronic devices, increase so that the metallic frame structure is still applied, which further reduces the antenna mounting space. Due to the current exterior design trend of electronic devices that reduces the weight, thickness, and size of the electronic devices, the antenna mounting space is further reduced. Consequently, due to the lack of antenna mounting space, the degradation of radiation performance may be caused in individual antennas.

Meanwhile, despite the antenna performance degradation and difficulty in implementing the antenna performance, the number of metallic components, which are applied to the exterior of electronic devices, has recently increased for the purpose of exterior design or stability of the electronic devices.

In this case, antennas may be classified as a type that is expanded from a bracket to be exposed to the outside of an electronic device, or a type that adopts a metallic frame. Further, according to the types of metallic frames applied to the exterior of an electronic device, antennas may be classified as a segmented type, a non-segmented type, a cover type, or a ring type.

In other words, with respect to using at least a portion of a metallic mechanical product that forms at least a portion of the exterior of an electronic device, antennas may be classified as follows.

According to a frame structure that encloses at least a portion of the exterior of an electronic device, antennas may be classified as a type that is integrally connected to a mechanical product (e.g., bracket) and encloses at least a portion of an electronic device, or a type that is not integrally implemented and encloses at least a portion of an electronic device.

In addition, according to a frame shape that encloses at least a portion of the exterior of an electronic device, antennas may be classified into a segmented type in which at least a section of the frame is segmented, and a non-segmented type in which the frame is not segmented.

In addition, antennas may be classified as a cover type that covers the rear face of a main body of the electronic device.

Further, by using a generally segmented metallic frame as a portion of an antenna, a structure, which uses a non-segmented metal as a ground face of an antenna, may be used.

When a metallic material is applied to the external case of an electronic device, it is possible to adjust the antenna wavelength used at the time of transmission/reception by variously segmented positions to the external case frame. In this case, when a dielectric material (e.g., a human's hand) is touched to a segmented portion of the external metallic case, a current flow is changed to greatly degrade radiation.

In order to address such a problem, an improvement has been discovered by switching an upper end/lower end antenna of an electronic device. However, this is not a suitable solution in a multiple input multiple output (MIMO) environment, such as a long term evolution (LTE) service.

In addition, when an external metallic case is used as an antenna, there may be a limit in using a metallic fixing unit, such as an inner metallic bracket, in order to enhance the mounting stability of an externally added device, to which a terminal is connected to the outside, such as an ear jack connector or a universal serial bus (USB) connector.

In addition, an external metallic frame (e.g., case) should be connected to an internal ground portion in order to reduce a deviation between electronic devices and to suppress the generation of spurious resonance. In such a case, a current induced on a substrate (printed circuit board (PCB)) ground portion may flow to the external metallic frame (case) of the electronic device, thereby increasing the risk of electric shock.

A technique related to an antenna and a ground structure according to various embodiments of the present disclosure is to solves a problem of degradation of radiation that is caused in a segmented portion in an external metallic case of an electronic device, a problem of constraint of a metallic component for fixing an ear jack connector or a USB connector that is mounted inside a metallic frame (e.g., case) that is used as an antenna, and an electric shock problem in the case where an external metallic frame (e.g., case) is connected to an internal ground portion or is used as an antenna.

A technique related to an antenna and a ground structure according to various embodiments of the present disclosure is to provide a structure that does not degrade radiation performance, involves less risk of electric shock, and secures stability in a portion, to which an external connector, such as an ear jack connector or a USB connector, is connected.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a technique related to an antenna.

In accordance with an aspect of the present disclosure, an antenna of an electronic device is provided. The antenna includes a substrate including a ground portion, an external metallic frame of the electronic device, a float ground portion arranged to be connected to the external metallic frame in a state of being disconnected from the substrate, and at least one radiator electrically connected to the float ground portion. Upon being fed with power, the at least one radiator may operate as an antenna radiator, or a section of the external metallic frame may operate as the antenna radiator.

In accordance with another aspect of the present disclosure, an electronic device is provided. The electronic device includes an internal bracket, a substrate arranged on the internal bracket, an external metallic frame of the electronic device, a float ground portion arranged to be connected to the external metallic frame in a state of being disconnected from the substrate, and at least one radiator electrically connected to the float ground portion. Upon being fed with power, the at least one radiator may operate as an antenna radiator, or a section of the external metallic frame may operate as the antenna radiator.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
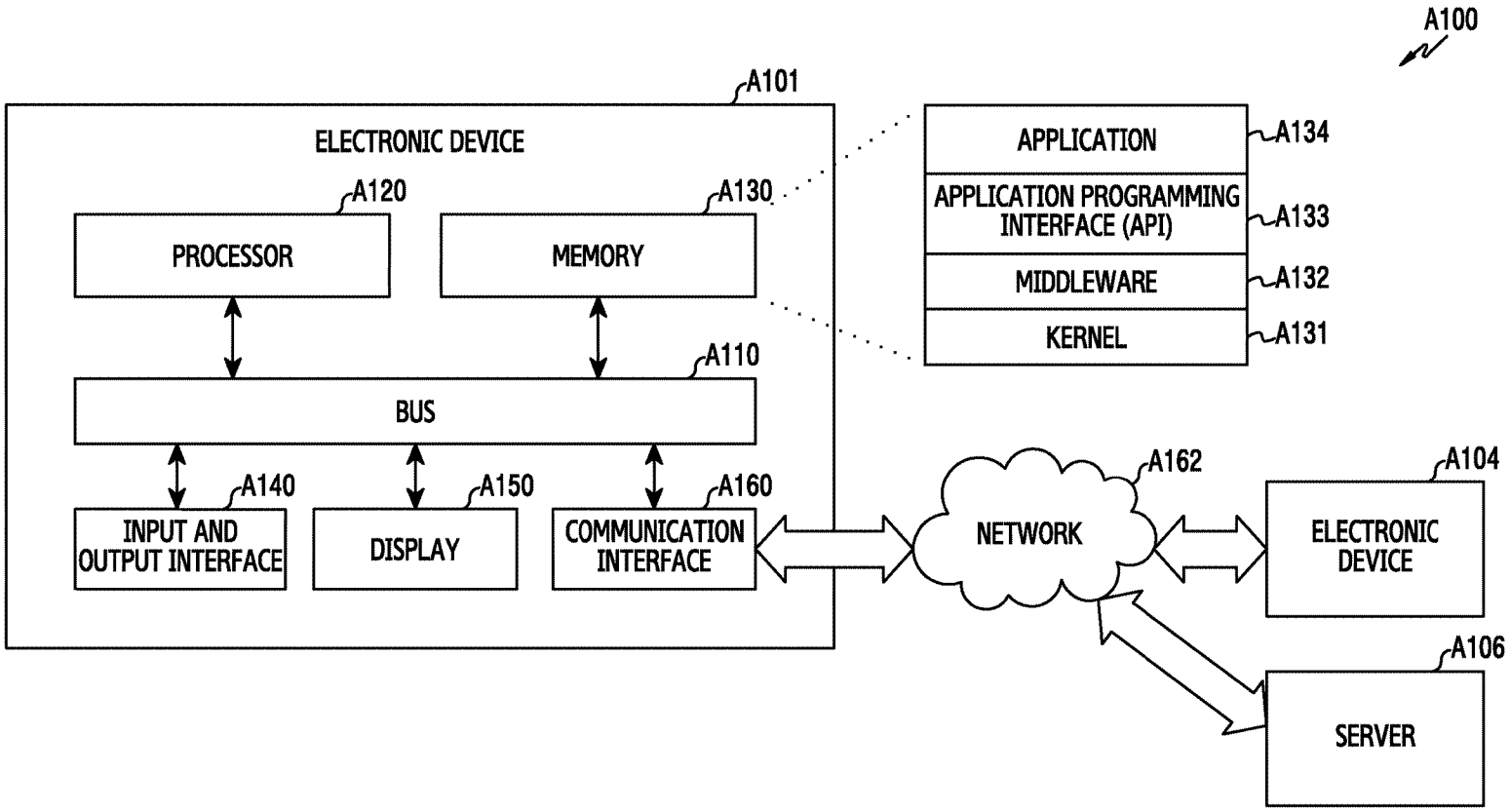
FIG. 1 illustrates a network environment including an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms "include" or "may include" used in the various embodiments of the present disclosure indicate the presence of disclosed corresponding functions, operations, elements, and the like, and do not limit additional one or more functions, operations, elements, and the like. In addition, it should be understood that the terms "include" or "have" used in the various embodiments of the present disclosure are to indicate the presence of features, numbers, operations, elements, parts, or a combination thereof described in the specifications, and do not preclude the presence or addition of one or more other features, numbers, operations, elements, parts, or a combination thereof.

The term "or" used in the various embodiments of the present disclosure include any and all combinations of words enumerated with it. For example, "A or B" means including A, including B, or including both A and B.

Although the terms such as "first" and "second" used in the various embodiments of the present disclosure may modify various elements of the various embodiments of the present disclosure, these terms do not limit the corresponding elements. For example, these terms do not limit an order and/or importance of the corresponding elements. These terms may be used for the purpose of distinguishing one element from another element. For example, a first electronic device and a second electronic device all indicate electronic devices and may indicate different electronic devices. For example, a first element may be named a second element without departing from the scope of right of the various embodiments of the present disclosure, and similarly, a second element may be named a first element.

It will be understood that, when an element is mentioned as being "connected" or "coupled" to another element, the element may be directly connected or coupled to another element, and there may be an intervening element between the element and another element. To the contrary, it will be understood that, when an element is mentioned as being "directly connected" or "directly coupled" to another element, there is no intervening element between the element and another element.

The terms used in the various embodiments of the present disclosure are for the purpose of describing specific embodiments only and are not intended to limit various embodiments of the present disclosure. All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having ideal or exaggerated meanings unless they are clearly defined in the various embodiments.

An electronic device according to various embodiments of the present disclosure may be a device that is equipped with a communication function. For example, the electronic device may include at least one of a smartphone, a tablet personal computer (PC), a mobile phone, a video phone, an electronic book reader, a desktop PC, a laptop PC, a netbook computer, a personal digital assistant (PDA), a portable multimedia player (PMP), a Moving Picture Experts Group phase 1 or phase 2 (MPEG-1 or MPEG-2) audio layer 3 (MP3) player, a mobile medical machine, a camera, or a wearable device (for example, a head-mounted-device (HMD) such as electronic glasses, electronic clothing, an electronic bracelet, an electronic necklace, an electronic appcessory, electronic tattoos, or a smart watch).

The electronic device according to various embodiments of the present disclosure may be one or a combination of one or more of the above-mentioned devices. In addition, the electronic device according to various embodiments of the present disclosure may be a flexible device. In addition, it is obvious to an ordinary skilled person in the related art that the electronic device according to various embodiments of the present disclosure is not limited to the above-mentioned devices.

Hereinafter, an electronic device according to various embodiments will be explained with reference to the accompanying drawings. The term "user" used in the various embodiments may refer to a person who uses the electronic device or a device that uses the electronic device (for example, an artificial intelligence electronic device).

FIG. 1 illustrates a view showing a network environment including an electronic device according to various embodiments of the present disclosure.

Referring to FIG. 1, the electronic device A101 may include a bus A110, a processor A120, a memory A130, an input and output interface A140, a display A150, and a communication interface A160.

The bus A110 may be a circuit which connects the above-described elements with one another and transmits communication (for example, a control message) between the above-described elements.

The processor A120 may receive instructions from the other elements (for example, the memory A130, the input and output interface A140, the display A150, the communication interface A160, and the like) via the bus A110, decipher the instructions, and perform calculation or data processing according to the deciphered instructions.

The memory A130 may store instructions or data which is received from or generated by the processor A120 or the other elements (for example, the input and output interface A140, the display A150, the communication interface A160, and the like). For example, the memory A130 may include programming modules such as a kernel A131, middleware A132, an application programming interface (API) A133, an application A134, and the like. Each of the above-described programming modules may be configured by software, firmware, hardware, or a combination of two or more of them.

The kernel A131 may control or manage system resources (for example, the bus A110, the processor A120, the memory A130, and the like) which are used for performing operations or functions implemented in the other programming modules, for example, the middleware A132, the API A133, or the application A134. In addition, the kernel A131 may provide an interface for allowing the middleware A132, the API A133, or the application A134 to access an individual element of the electronic device A100 and control or manage the element.

The middleware A132 may serve as an intermediary to allow the API A133 or the application A134 to communicate with the kernel A131 and exchange data with the kernel A131. In addition, the middleware A132 may perform controlling (for example, scheduling or load balancing) with respect to work requests received from the application A134, for example, by giving priority to use the system resources of the electronic device A100 (for example, the bus A110, the processor A120, the memory A130, and the like) to at least one application.

The API A133 may be an interface for allowing the application A134 to control a function provided by the kernel A131 or the middleware A132, and, for example, may include at least one interface or function (for example, instructions) for controlling a file, controlling a window, processing an image, or controlling a text.

According to various embodiments of the present disclosure, the application A134 may include a short message service (SMS)/multimedia messaging service (MIMS) application, an email application, a calendar application, a notification application, a health care application (for example, an application for measuring exercise or a blood sugar), an environment information application (for example, an application for providing information on atmospheric pressure, humidity, or temperature), and the like. Additionally or alternatively, the application A134 may be an application related to information exchange between the electronic device A100 and an external electronic device (for example, an electronic device A104). For example, the application related to the information exchange may include a notification relay application for relaying specific information to an external electronic device or a device management application for managing an external electronic device.

For example, the notification relay application may include a function of relaying notification information generated by other applications of the electronic device A100 (for example, the SMS/MMS application, the email application, the health care application, the environment information application, and the like) to an external electronic device (for example, the electronic device A104). Additionally or alternatively, the notification relay application may receive notification information from an external electronic device (for example, the electronic device A104) and may provide the same to the user. For example, the device management application may manage (for example, install, delete or update) a function regarding at least part of an external electronic device (for example, the electronic device A104) communicating with the electronic device A100 (for example, turning on/off the external electronic device (or some parts) or adjusting brightness (or resolution) of a display), an application operating in the external electronic device or a service provided by the external electronic device (for example, a calling service or a message service).

According to various embodiments of the present disclosure, the application A134 may include an application which is specified according to the attribute (for example, a kind of an electronic device) of an external electronic device (for example, the electronic device A104). For example, when the external electronic device is an MP3 player, the application A134 may include an application related to music replay. Similarly, when the external electronic device is a mobile medical device, the application A134 may include an application related to health care. According to an embodiment of the present disclosure, the application A134 may include at least one of an application specified by the electronic device A100 or an application received from an external electronic device (for example, a server A106 or the electronic device A104).

The input and output interface A140 may transmit instructions or data inputted by a user through an input and output device (for example, a sensor, a keyboard or a touch screen) to the processor A120, the memory A130, or the communication interface A160 through the bus A110, for example. For example, the input and output interface A140 may provide data on a user's touch inputted through a touch screen to the processor A120. In addition, the input and output interface A140 may output instructions or data received from the processor A120, the memory A130, or the communication interface A160 through the bus A110 through the input and output device (for example, a speaker or a display). For example, the input and output interface A140 may output voice data processed through the processor A120 to the user through a speaker.

The display A150 may display a variety of information (for example, multimedia data, text data, and the like) for the user.

The communication interface A160 may connect communication between the electronic device A100 and an external device (for example, the electronic device A104 or the server A106). For example, the communication interface A160 may be connected to a network A162 via wireless communication or wire communication to communicate with the external device. The wireless communication may include at least one of Wi-Fi, Bluetooth (BT), near field communication (NFC), a global positioning system (GPS), or cellular communication (for example, long term evolution (LIE), LTE-advanced (LTE-A), code division multiple access (CDMA), wideband CDMA (WCDMA), universal mobile telecommunications service (UMTS), wireless broadband (WiBro), global system for mobile communications (GSM), and the like). The wire communication may include at least one of a USB, a high definition multimedia interface (HDMI), a recommended standard 232 (RS-232), or plain old telephone service (POTS).

According to various embodiments of the present disclosure, the network A162 may be a telecommunications network. The telecommunications network may include at least one of a computer network, Internet, Internet of things, or a telephone network. According to an embodiment of the present disclosure, a protocol for communicating between the electronic device A101 and the external device (for example, a transport layer protocol, a data link layer protocol or a physical layer protocol) may be supported in at least one of the application A134, the API A133, the middleware A132, the kernel A131, or the communication interface A160.

Figure 2:
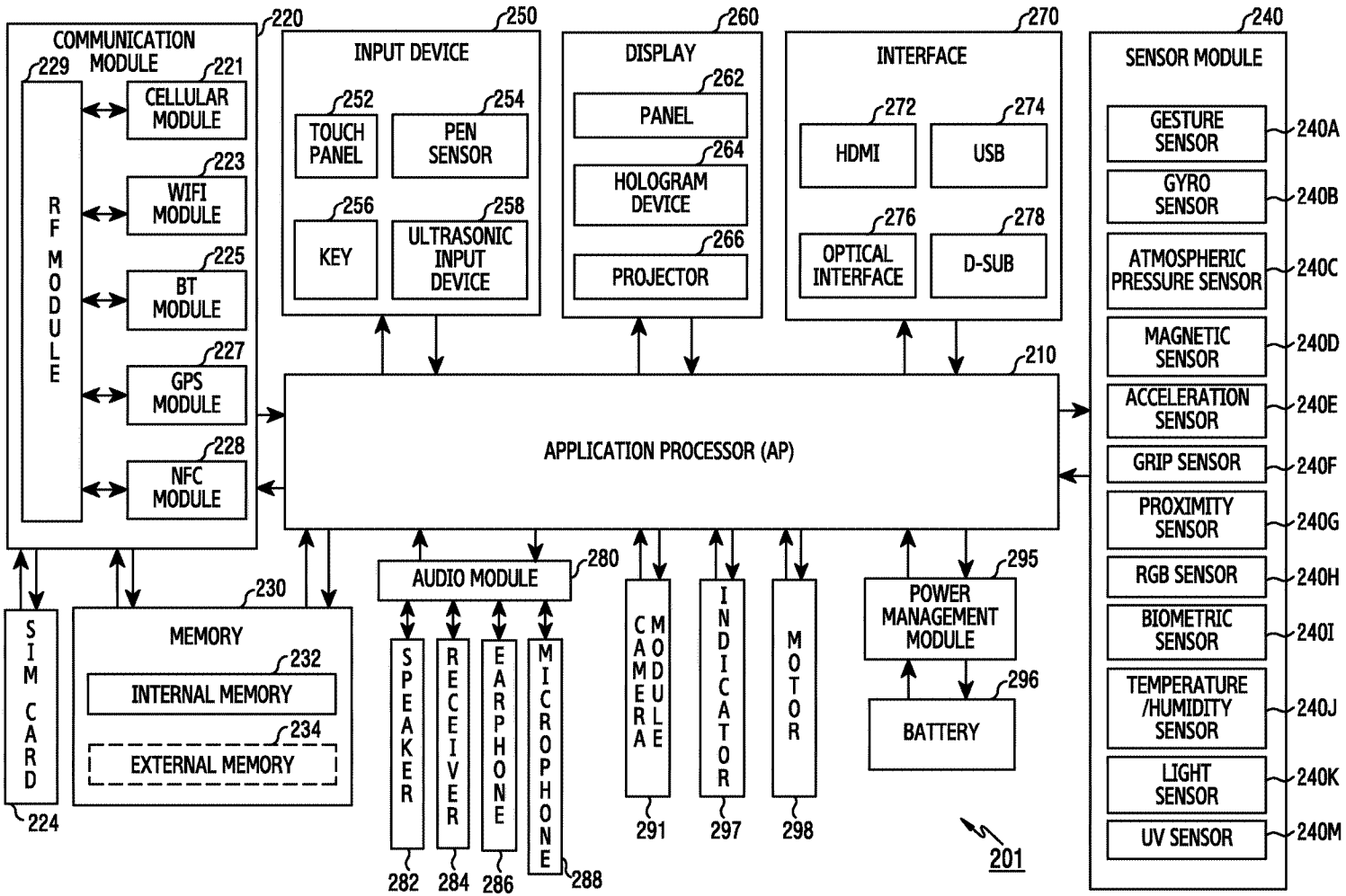
FIG. 2 illustrates a block diagram of an electronic device according to various embodiments of the present disclosure.

FIG. 2 illustrates a block diagram of an electronic device according to various embodiments of the present disclosure. The electronic device 201 may configure the entirety or part of the electronic device 101 shown in FIG. 1.

Referring to FIG. 2, the electronic device 201 may include one or more application processors (APs) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, or a motor 298.

The AP 210 may control a plurality of hardware or software elements connected to the AP 210 by driving an operating system or an application program, and may process and calculate a variety of data including multimedia data. For example, the AP 210 may be implemented by using a system on chip (SoC). According to an embodiment of the present disclosure, the AP 210 may further include a graphics processing unit (GPU) (not shown).

The communication module 220 (for example, the communication interface 160) may transmit and receive data via communication between the electronic device 201 (for example, the electronic device 101) and other electronic devices (for example, the electronic device 104 or the server 106) connected through a network. According to an embodiment of the present disclosure, the communication module 220 may include a cellular module 221, a Wi-Fi module 223, a BT module 225, a GPS module 227, an NFC module 228, and a radio frequency (RF) module 229.

The cellular module 221 may provide a voice call, a video call, a text service, or an internet service through a telecommunications network (for example, LTE, LTE-A, CDMA, WCDMA, UMTS, WiBro, GSM, and the like). In addition, the cellular module 221 may identify and authenticate the electronic device in the telecommunications network by using a SIM (for example, the SIM card 224). According to an embodiment of the present disclosure, the cellular module 221 may perform at least some of the functions provided by the AP 210. For example, the cellular module 221 may perform at least some of the multimedia control functions.

According to an embodiment of the present disclosure, the cellular module 221 may include a communication processor (CP). In addition, the cellular module 221 may be implemented by using an SoC, for example. In FIG. 2, the cellular module 221 (for example, the communication processor), the memory 230, or the power management module 295 are elements separate from the AP 210. However, according to an embodiment of the present disclosure, the AP 210 may be configured to include at least some of the above-described elements (for example, the cellular module 221).

According to an embodiment of the present disclosure, the AP 210 or the cellular module 221 (for example, the communication processor) may load instructions or data received from a non-volatile memory connected therewith or at least one of the other elements into a volatile memory, and may process the instructions or data. In addition, the AP 210 or the cellular module 221 may store data which is received from at least one of the other elements or generated by at least one of the other elements in the non-volatile memory.

The Wi-Fi module 223, the BT module 225, the GPS module 227, or the NFC module 228 each may include a processor for processing data received and transmitted through a corresponding module. In FIG. 2, the cellular module 221, the Wi-Fi module 223, the BT module 225, the GPS module 227, or the NFC module 228 is illustrated in a separate block. However, according to an embodiment of the present disclosure, at least some (for example, two or more) of the cellular module 221, the Wi-Fi module 223, the BT module 225, the GPS module 227, or the NFC module 228 may be included in a single integrated chip (IC) or a single IC package. For example, at least some of the processors corresponding to the cellular module 221, the Wi-Fi module 223, the BT module 225, the GPS module 227, and the NFC module 228 (for example, the communication processor corresponding to the cellular module 221 and the Wi-Fi processor corresponding to the Wi-Fi module 223) may be implemented by using a single SoC.

The RF module 229 may transmit and receive data, for example, may transmit and receive an RF signal. Although not shown, the RF module 229 may include a transceiver, a power amp module (PAM), a frequency filter, or a low noise amplifier (LNA), for example. In addition, the RF module 229 may further include a part for exchanging electromagnetic waves in a free space in wireless communication, for example, a conductor or conducting wire. In FIG. 2, the cellular module 221, the Wi-Fi module 223, the BT module 225, the GPS module 227, and the NFC module 228 share the single RF module 229 with one another. However, according to an embodiment of the present disclosure, at least one of the cellular module 221, the Wi-Fi module 223, the BT module 225, the GPS module 227, or the NFC module 228 may transmit and receive an RF signal through a separate RF module.

The SIM card 224 may be a card including a SIM, and may be inserted into a slot formed on a specific location of the electronic device. The SIM card 224 may include unique identification information (for example, an integrated circuit card identifier (ICCID)) or subscriber information (for example, international mobile subscriber identity (IMSI)).

The memory 230 (for example, the memory 130) may include an internal memory 232 or an external memory 234. For example, the internal memory 232 may include at least one of a volatile memory (for example, a dynamic random access memory (DRAM), a static RAM (SRAM), a synchronous DRAM (SDRAM), and the like) and a non-volatile memory (for example, a one-time programmable read only memory (OTPROM), a PROM, an erasable PROM (EPROM), an electrically erasable PROM (EEPROM), a mask ROM, a flash ROM, a NAND flash memory, a NOR flash memory, and the like).

According to an embodiment of the present disclosure, the internal memory 232 may be a solid state drive (SSD). The external memory 234 may further include a flash drive, for example, compact flash (CF), secure digital (SD), micro-SD, mini-SD, extreme-Digital (xD), a memory stick, and the like. The external memory 234 may be functionally connected with the electronic device 201 through various interfaces. According to an embodiment of the present disclosure, the electronic device 201 may further include a storage device (or a storage medium) such as a hard drive.

The sensor module 240 may measure a physical quantity or detect an operation state of the electronic device 201, and may convert measured or detected information into electric signals. The sensor module 240 may include at least one of a gesture sensor 240A, a gyro sensor 240B, a barometric pressure sensor 240C, a magnetic sensor 240D, an acceleration sensor 240E, a grip sensor 240F, a proximity sensor 240G, a color sensor 240H (e.g., red, green, blue (RGB) sensor), a biosensor 240I, a temperature/humidity sensor 240J, an illumination sensor 240K, and an ultraviolet (UV) sensor 240M. Additionally or alternatively, the sensor module 240 may include an E-nose sensor (not shown), an electromyography (EMG) sensor (not shown), an electroencephalogram (EEG) sensor (not shown), an electrocardiogram (ECG) sensor (not shown), an infrared ray (IR) sensor, an iris sensor (not shown), a fingerprint sensor (not shown), and the like. The sensor module 240 may further include a control circuit to control at least one sensor included therein.

The input device 250 may include a touch panel 252, a (digital) pen sensor 254, a key 256, or an ultrasonic input device 258. The touch panel 252 may recognize a touch input in at least one method of capacitive, resistive, infrared, and ultrasonic methods. In addition, the touch panel 252 may further include a control circuit (not shown). In the embodiment of a capacitive method, the touch panel 252 may recognize physical contact or hovering. The touch panel 252 may further include a tactile layer. In this embodiment, the touch panel 252 may provide a tactile response to the user.

The (digital) pen sensor 254 may be implemented in the same or similar method as or to the method of receiving a user's touch input or by using a separate detection sheet. The key 256 may include a physical button, an optical key, or a keypad. The ultrasonic input device 258 allows the electronic device 201 to detect sound waves through a microphone (for example, the microphone 288) through an input tool generating ultrasonic signals and identify data, and is capable of wireless recognition. According to an embodiment of the present disclosure, the electronic device 201 may receive a user input from an external device connected thereto (for example, a computer or a server) by using the communication module 220.

The display 260 (for example, the display 150) may include a panel 262, a hologram device 264, or a projector 266. For example, the panel 262 may be a liquid crystal display (LCD) or an active matrix organic light emitting diode (AM-OLED). For example, the panel 262 may be implemented to be flexible, transparent, or wearable. The panel 262 may be configured as a single module along with the touch panel 252. The hologram device 264 may show a stereoscopic image in the air using interference of light. The projector 266 may display an image by projecting light onto a screen. The screen may be located inside or outside the electronic device 201. According to an embodiment of the present disclosure, the display 260 may further include a control circuit to control the panel 262, the hologram device 264, or the projector 266.

The interface 270 may include an HDMI 272, a USB 274, an optical interface 276, or D-subminiature (D-sub) 278. The interface 270 may be included in the communication interface 160 shown in FIG. 1. Additionally or alternatively, the interface 270 may include a mobile high definition link (MHL) interface, an SD/multimedia card (MMC) interface or infrared data association (IrDA) standard interface.

The audio module 280 may convert a sound and an electric signal bidirectionally. At least some element of the audio module 280 may be included in the input and output interface 140 of FIG. 1. The audio module 280 may process sound information which is input or output through a speaker 282, a receiver 284, an earphone 286, or a microphone 288.

The camera module 291 is a device for photographing a still image and a moving image, and, according to an embodiment of the present disclosure, the camera module 291 may include one or more image sensors (for example, a front surface sensor or a rear surface sensor), a lens (not shown), an image signal processor (ISP) (not shown), or a flash (memory) (for example, an LED or a xenon lamp).

The power management module 295 may manage power of the electronic device 201. Although not shown, the power management module 295 may include a power management IC (PMIC), a charger IC, or a battery or fuel gauge.

For example, the PMIC may be mounted in an integrated circuit or an SoC semiconductor. The charging method may be divided into a wire charging method and a wireless charging method. The charger IC may charge a battery and may prevent inflow of overvoltage or over current from a charger. According to an embodiment of the present disclosure, the charger IC may include a charger IC for at least one of the wire charging method and the wireless charging method. The wireless charging method may include a magnetic resonance method, a magnetic induction method, or an electromagnetic wave method, and an additional circuit for charging wirelessly, for example, a circuit such as a coil loop, a resonant circuit, a rectifier, and the like may be added.

For example, the battery gauge may measure a remaining battery life of the battery 296, a voltage, a current, or temperature during charging. The battery 296 may store or generate electricity and may supply power to the electronic device 201 by using stored or generated electricity. The battery 296 may include a rechargeable battery or a solar battery.

The indicator 297 may display a specific state of the electronic device 201 or a part of it (for example, the AP 210), for example, a booting state, a message state, or a charging state. The motor 298 may convert an electric signal into a mechanical vibration. Although not shown, the electronic device 201 may include a processing device (for example, a GPU) for supporting a mobile TV. The processing device for supporting the mobile TV may process media data according to standards such as digital multimedia broadcasting (DMB), digital video broadcasting (DVB), or media flow.

Each of the above-described elements of the electronic device according to various embodiments of the present disclosure may be comprised of one or more components, and the names of the elements may vary according to the kind of the electronic device. The electronic device according to various embodiments of the present disclosure may include at least one of the above-described elements, and some of the elements may be omitted or an additional element may be further included. In addition, some of the elements of the electronic device according to various embodiments of the present disclosure may be combined into a single entity, and may perform the same functions as those of the elements before being combined.

Figure 3:
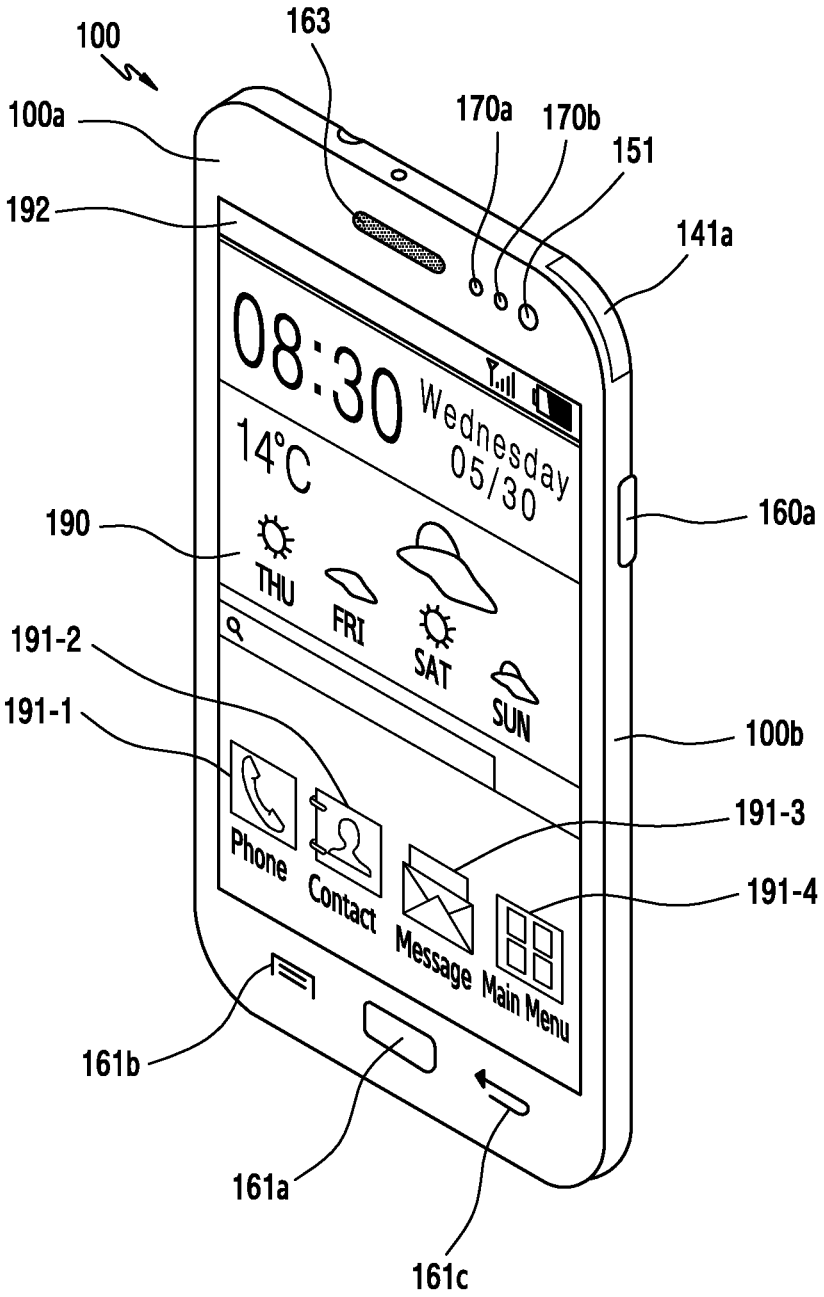
FIG. 3 is a perspective view illustrating a front face of an electronic device according to various embodiments of the present disclosure.
Figure 4:
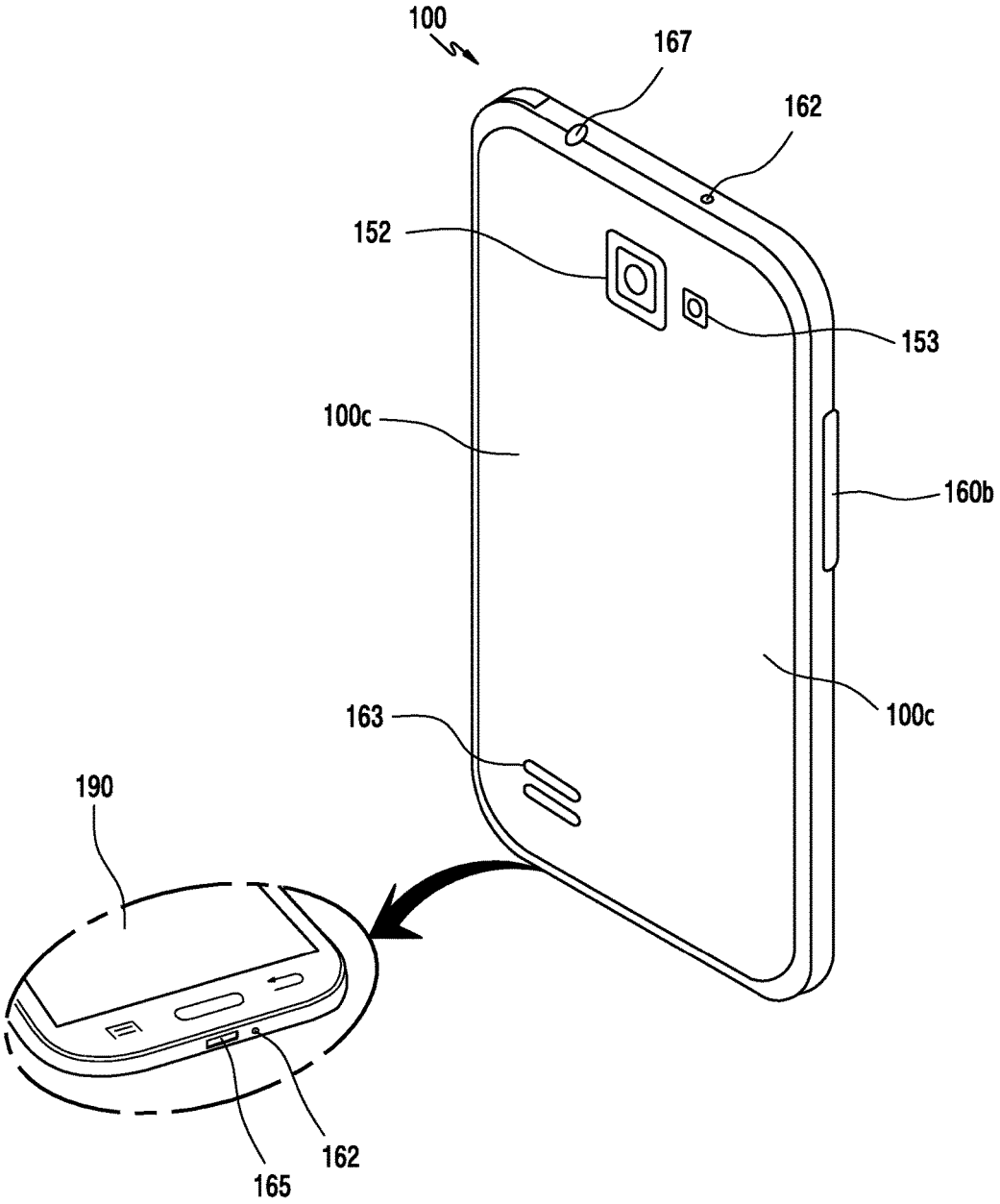
FIG. 4 is a perspective view illustrating a rear face of the electronic device according to various embodiments of the present disclosure.

FIG. 3 is a perspective view illustrating a front face of an electronic device according to various embodiments of the present disclosure. FIG. 4 is a perspective view illustrating a rear face of the electronic device according to various embodiments of the present disclosure.

Referring to FIGS. 3 and 4, the electronic device 100 may have an exterior that is formed by a front face 100*a*, a rear face 100*c*, and one or more side rims 100*b*. The electronic device 100 may include a touch screen 190 that may be arranged on the front face 100*a* using a structure, such as a case, a rear cover or a battery cover that may be configured on the rear face 100*c*, or one or more keys 160*a* and 160*b*, a USB connector 165, an earphone connecting jack connector 167, or the like that may be arranged on the side rims 100*b*. In the exterior structure of the electronic device 100, the case may include a synthetic resin, a metallic material, or a combination thereof. For example, the case that forms the exterior of the electronic device 100 may be entirely made of an injection molded material. In addition, the case that forms the exterior of the electronic device 100 may be entirely made of a metallic material. In addition, at least a portion of the exterior case of the electronic device 100 may be made of an injection molded material, and the remaining portion may be made of a metallic material.

For example, when at least a portion of the side rims 100*b* of the electronic device 100 is made of a metallic material, it may be used as an antenna. When at least a portion of the side rims 100*b* is used as an antenna, among the side rims 100*b*, a metallic rim that is positioned in the upper end, a metallic rim that is positioned in the lower end, or a metallic rim that is positioned in a side end may be used as a radiator of an antenna. In addition, when at least a portion of the side rims 100*b* of the electronic device 100 is made of a metallic material, it may be used as a structure for reinforcing the mounting of an earphone connecting jack connector 167 or a USB connector 165, and may make the exterior look luxurious. According to various embodiments of the present disclosure, a portion of the exterior of the electronic device is used as an antenna. In particular, a metallic rim may be used as an antenna radiator.

A touch screen 190 is arranged in the center of the front face 100*a* of the electronic device 100. The touch screen 190 is formed in a large size to occupy the greater portion of the front face 100*a* of the electronic device 100. FIG. 3 illustrates an example in which a main home screen is displayed on the touch screen 190. The main home screen refers to the first screen that is displayed on the touch screen 190 when the power of the electronic device 100 is turned on. In addition, in the case where the electronic device 100 includes several pages of different home screens, the main home screen may be the first home screen among the several pages of home screens. On the home screen, shortcut icons 191-1, 191-2, and 191-3 for executing frequently used applications, a main menu switching key 191-4, time, weather, or the like may be indicated. The main menu switching key 191-4 causes a menu screen to be indicated on the touch screen 190. In addition, in the upper end portion of the touch screen 190, status bars 192 that indicate the status of the electronic device 100, such as a battery charge status, received signal strength, and the present time may be formed. In the lower portion of the touch screen 190, a home button 161*a*, a menu button 161*b*, and a back button 161*c* may be formed.

The home button 161*a* causes the main home screen to be displayed on the touch screen 190. For example, when the home key is touched in the state where a home screen, which is different from the main home screen or the menu screen, is displayed on the touch screen 190, the main home screen may be displayed on the touch screen 190. In addition, when the home button 161*a* is touched while the applications are executed on the touch screen 190, the main home screen illustrated in FIG. 3 may be displayed on the touch screen 190. In addition, the home button 161*a* may also be used to cause recently used applications to be displayed on the touch screen 190, or to cause a task manger to be displayed on the touch screen 190.

The menu button 161*b* provides a connection menu that may be used on the touch screen 190. The connection menu may include a widget adding menu, a background screen change menu, a retrieve menu, an edition menu, an environment setting menu, or the like. The back button 161*c* may cause a screen, which was executed just before the currently executed screen, to be displayed, or may terminate the most recently used application.

In an edge of the front face 100*a* of the electronic device 100, a first camera 151, an illuminance sensor 170*a*, and a proximity sensor 170*b* may be arranged. On the rear face 100*c* of the electronic device 100, a second camera 152, a flash 153, and a speaker 163 may be arranged.

On the side faces 100*b* of the electronic device 100, for example, a power/reset button key 160*a*, a volume button key 160*b*, a terrestrial DMB antenna 141*a* for broadcasting reception, and one or more mics 162 may be arranged. The DMB antenna 141*a* may be fixed to the electronic device 100 or formed to be attachable to/detachable from the electronic device 100.

In addition, the USB connector 165 may be mounted on the lower end side face of the electronic device 100. The USB connector 165 may be formed with a plurality of electrodes to be connected with an external device via a wire. On the upper end side face of the electronic device 100, the earphone connecting jack connector 167 may be arranged. An earphone may be inserted into the earphone connecting jack connector 167. The earphone connecting jack connector 167 may be arranged on the rim, which is positioned on the lower end of the electronic device 100.

Hereinafter, a configuration of an antenna according to various embodiments of the present disclosure will be described with reference to the accompanying drawings.

Figure 5:
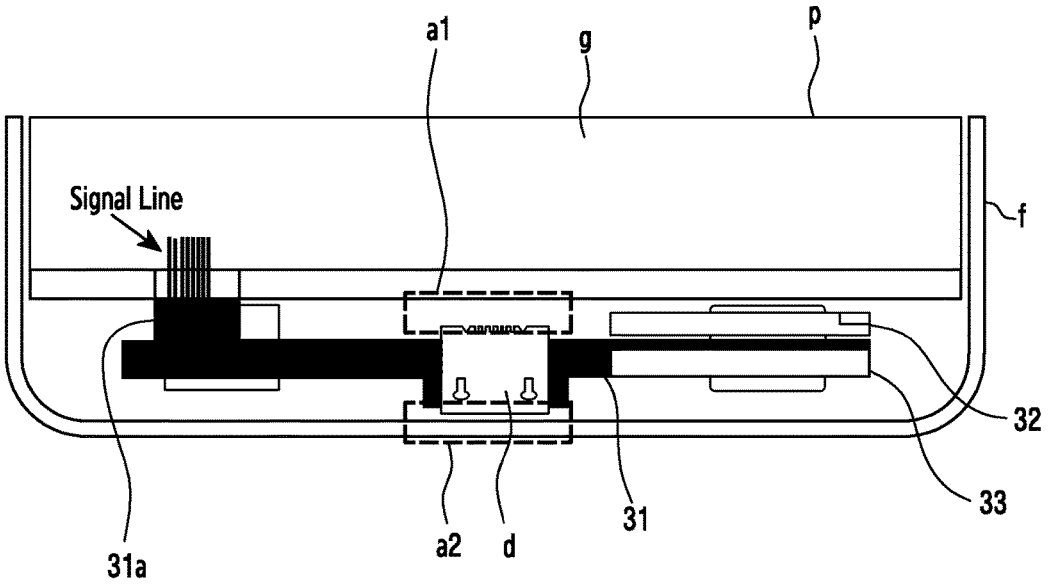
FIG. 5 is a view illustrating an antenna that is provided in an electronic device according to various embodiments of the present disclosure.

FIG. 5 is a view illustrating an antenna that is provided in an electronic device according to various embodiments of the present disclosure.

Referring to FIG. 5, an antenna according to various embodiments of the present disclosure may include one or more radiators 32 and 33, one or more ground portions g and 31, and an external metallic frame f that is arranged to surround a substrate p. The substrate p may include a first ground portion g, more specifically, a first ground face, and a second ground portion 31 that is arranged to be connected to the substrate p via a connecting portion 31*a*. An antenna pattern portion 33 and a metallic component d may be arranged in the second ground portion 31. When power is fed to the antenna pattern portion 32, the antenna pattern portion 32 may operate as a radiator. A metallic accessory d may be arranged on the second ground portion 31 with a gap a2 being interposed between the metallic accessory d and the external metallic frame, and a gap a1 being interposed between the metallic accessory d and the first ground portion g.

Although the ground function of such an antenna is strengthened, there may be a limit in using a metallic fixing unit (metallic accessory) in order to enhance the mounting stability of an externally added device to which a terminal is connected from the outside, such as an earphone connecting jack (ear jack) or a USB connector, in the case where the external metallic frame f is used as an antenna.

In addition, the outwardly visible metallic accessory d should be connected to an internal ground portion in order to reduce a deviation between electronic devices and to suppress the generation of spurious resonance. In such a case, a current induced on the ground portion g of the substrate p may flow to the external metallic case such that there is risk of electric shock.

Hereinafter, descriptions will be made on an antenna configuration, according to various embodiments of the present disclosure, which solves the above-mentioned problems.

Figure 6:
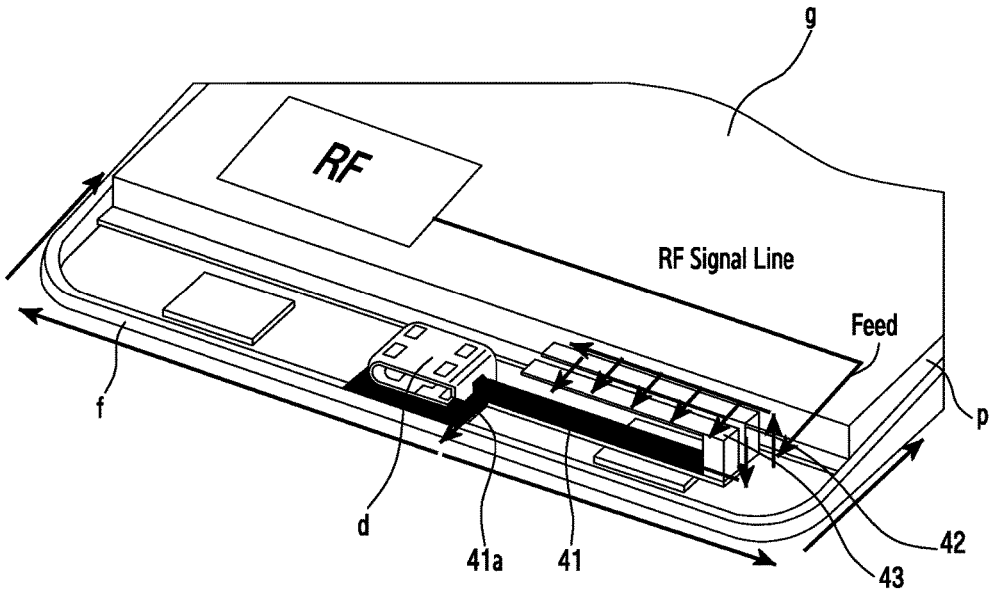
FIG. 6 is a perspective view illustrating an antenna that is provided in an electronic device according to various embodiments of the present disclosure.
Figure 7:
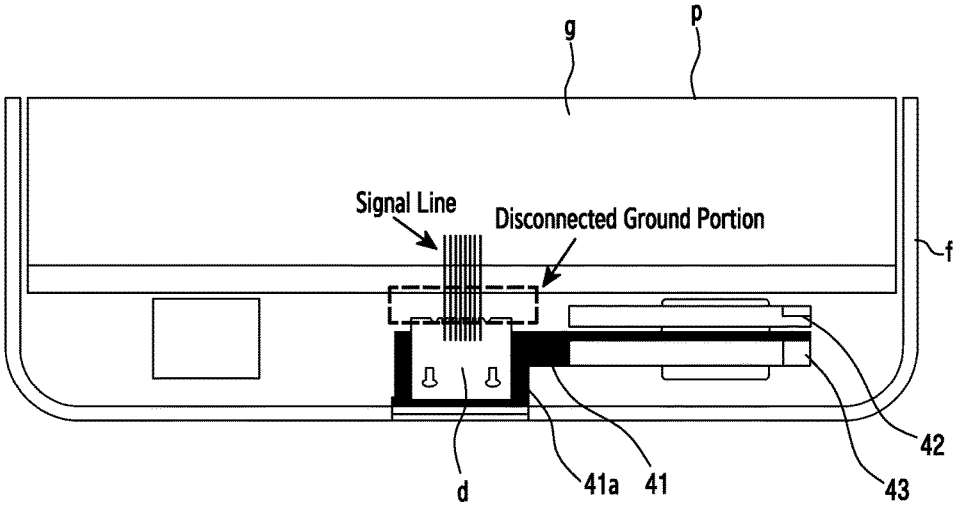
FIG. 7 is a plan view illustrating the antenna shown in FIG. 6 according to various embodiments of the present disclosure.

FIG. 6 is a perspective view illustrating an antenna that is provided in an electronic device according to various embodiments of the present disclosure. FIG. 7 is a plan view illustrating the antenna shown in FIG. 6 according to various embodiments of the present disclosure.

Referring to FIGS. 6 and 7, according to various embodiments of the present disclosure, an antenna may include a ground portion g, one or more radiators 42 and 43, one or more float ground portions 41, and an external metallic frame f.

In describing the antenna according to various embodiments of the present disclosure, a component made of a conductive material (hereinafter, referred to as a "conductive material component") refers to a component that is related to the exterior of an electronic device among a number of components that are mounted in the electronic device, and may include a metallic material.

Referring to FIGS. 3 and 4 again, representative components, which are made of a conductive and related to the exterior, may include cases 100*a*, 100*b*, and 100*c* that form the exterior, a USB connector 165, an earphone connecting jack connector 167, a camera module 152, a flash 153, keys 160*a* and 160*b*, a receiver 163, and a plurality of arranged sensors 170*a* and 170*b*.

In particular, components, which are made of a conductive while being related to the exterior, may include exterior cases 100*a*, 100*b*, and 100*c* that form the exterior, a USB connector 165, an earphone connecting jack connector 167, a camera module 152, a flash 153, keys 160*a* and 160*b*, and a receiver 163. Accordingly, each of the above-described components may include a housing that forms the exterior. In particular, each of the components may include a housing that is made of a metallic material for stable mounting. Of course, although the housing of the components may be made of an injection molded material, the following descriptions will be made assuming that the conductive material components are made of a metallic material. In particular, the conductive material components, such as the USB connector and the earphone connecting jack connector, should be made of a metallic material in consideration of the attachment/detachment of an externally added device. However, the remaining components may be made of a metallic material or an injection molded material.

Referring to FIGS. 6 and 7 again, the substrate p (PCB) is a component on which a plurality of components are mounted through a surface mount device (SMD) process. The substrate p may include a ground portion (ground face) in at least an area thereof and may typically be configured in a single layer or multiple layers. In addition, an RF unit is mounted on the substrate p, and an RF signal may be fed to the radiator 42. A power feeding unit is not illustrated in the drawings.

The external metallic frame f forms at least a portion of the rim of the metallic housing that forms the exterior of the electronic device. In particular, the external metallic frame f may be a portion that encloses the circumference of the side faces of the electronic device. In addition, the external metallic frame f may be configured in a segmented type or a non-segmented type. As will be described below, the external metallic frame f may have a predetermined thickness and may be configured in various shapes.

One or more float ground portions 41 (float grounds) may be provided at positions that are disconnected from the substrate p in a space between the substrate p and the external metallic frame f, and may be configured in various shapes. In addition, the float ground portion 41 may be used as radiators to operate as antennas. The float ground portion 41 may be configured by being plated in at least an area of a rigid substrate, or at least an area of a flexible substrate (flexible PCB (FPCB)). Further, the float ground portion 41 may be formed of a thin metal plate or metal sheet. According to various embodiments of the present disclosure, the float ground portion 41 may be electrically and mechanically connected to the external metallic frame f via a connecting portion 41*a*. The float ground portion 41 may be electrically connected to the external metallic frame f through an inductor (L), a capacitor (C), a separate component that may exhibit the effect of the capacitor, a mechanical structure, or the like. For the float ground portion 41, a separate contact terminal or clip, a metallic body, a conductive tape or sheet, or the like may be used.

The conductive material component d may be disposed on the float ground portion 41, and then may be mounted on the external metallic frame for may be coupled to an abutment, which is provided on the external metallic frame, using a screw with a gap being formed between the float ground portion 41 and the abutment. The conductive material component d may include a USB connector housing, an earphone connector housing, a camera module housing, a receiver housing, or the like. Hereinafter, the conductive material component d will be described with reference to the housing, by way of an example, that is made of a metallic material and forms the exterior of the USB connector.

The radiator may include one or more radiating members. The radiator may include a main radiator 42 that operates when power is fed thereto, and an auxiliary radiator 43 that operates to be coupled to the main radiator 42. The main radiator 42 is fed with power from a power feeding unit that is positioned on the substrate p, and a matching device or a tuner may be provided between the main radiator 42 and the power feeding unit. The auxiliary radiator 43 may be arranged on the float ground portion 41 to be electrically conductive with each other. There may be provided one or more main radiators 42 or auxiliary radiators 43. Each of the main radiator 42 and the auxiliary radiator 43 may be configured on an antenna carrier (not illustrated) using a metallic material.

When power is fed to the main radiator 42, the main radiator 42 may operate as a first band antenna radiator (e.g., a high band antenna radiator), and the auxiliary radiator 43 coupled to the main radiator 42 applies a current to the external metallic frame f via the float ground portion 41 so that the external metallic frame f may operate as a second band antenna radiator (e.g., a low band antenna radiator). Accordingly, the antenna according to various embodiments of the present disclosure may operate as a multi-band antenna. The main radiator 42 and the auxiliary radiator 43 may have individual antenna patterns for different antenna bands, and the two radiators 42 and 43 may operate for one band.

A signal line of the USB connector, which is provided in the conductive material component d, may be electrically connected to the substrate p across a region in which no float ground portion exists. In addition, the signal line of the USB connector may be electrically connected to the substrate p along the inner wall of the external metallic frame f. For the signal line, a wire or a flexible circuit board may be used.

In addition, the conductive material component d may be mounted on the external metallic frame for a region that extends from the external metallic frame using a fastener, or may be mounted on the internal bracket using a fastener.

Figure 8:
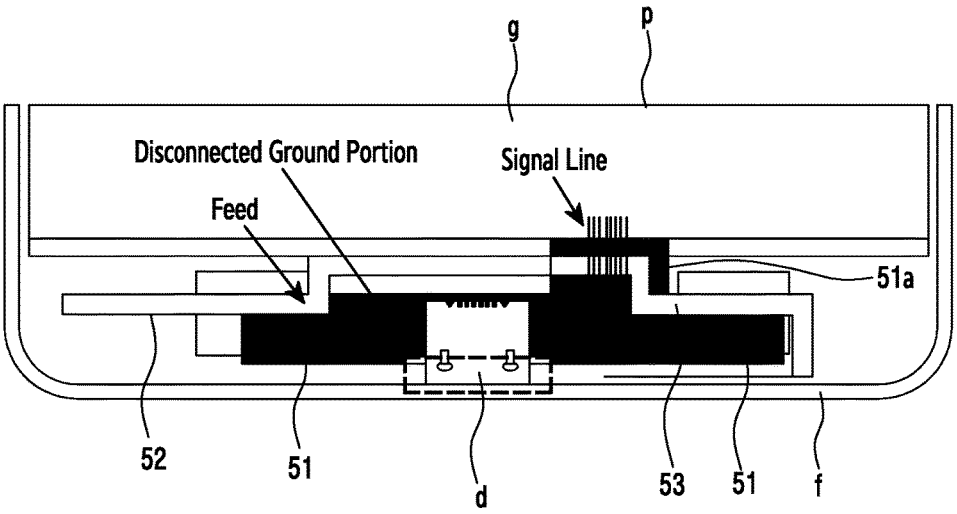
FIG. 8 is a view illustrating an antenna that is provided in an electronic device according to various embodiments of the present disclosure.

FIG. 8 is a view illustrating an antenna that is provided in an electronic device according to various embodiments of the present disclosure.

Referring to FIG. 8, the antenna according to an embodiment may include one or more radiators 52 and 53, one or more ground portion g and 51, and an external metallic frame f arranged to enclose the substrate p. The substrate p may include a first ground portion g, more specifically a first ground face, and a second ground portion 51 that is arranged to be connected to the substrate p. On the second ground portion 51, the radiators 52 and 53 and the conductive material component d may be disposed. The radiators 52 and 53 may operate as an antenna when power is fed thereto. At least a portion of the main radiator 52, which operates as the antenna, may be fed with power on the second ground portion 51, and at least a portion of the auxiliary radiator 53 may be disposed on the second ground portion 51 to be electrically connected with the second ground portion 51.

The second ground portion 51 is directly connected to the substrate p by the connecting portion 51*a* so as to strengthen the ground function, and the conductive material component d may be disposed across a portion of the second ground portion in the state where it is spaced apart from the external metallic frame f. The second ground portion 51 may be disposed in the state where it is disconnected from the external metallic frame f.

Such an antenna is strengthened in the ground function. However, when the antenna is used as an external metallic frame f antenna, there may be a limit in using a conductive material component in order to enhance the mounting stability of an externally added device, to which a terminal is connected in the outside, such as an earphone connecting jack connector or a USB connector.

In addition, the external conductive material component should be connected to an internal ground portion in order to the deviation between electronic devices and to suppress the generation of spurious resonance. In such a case, the current, which is induced on the first ground portion g of the substrate p, may flow to the external conductive material component d of the electronic device such that there is risk of electric shock.

Hereinafter, with reference to FIGS. 9 and 10, descriptions will be made on an antenna configuration according to various embodiments of the present disclosure, which solves the problems described above.

Figure 9:
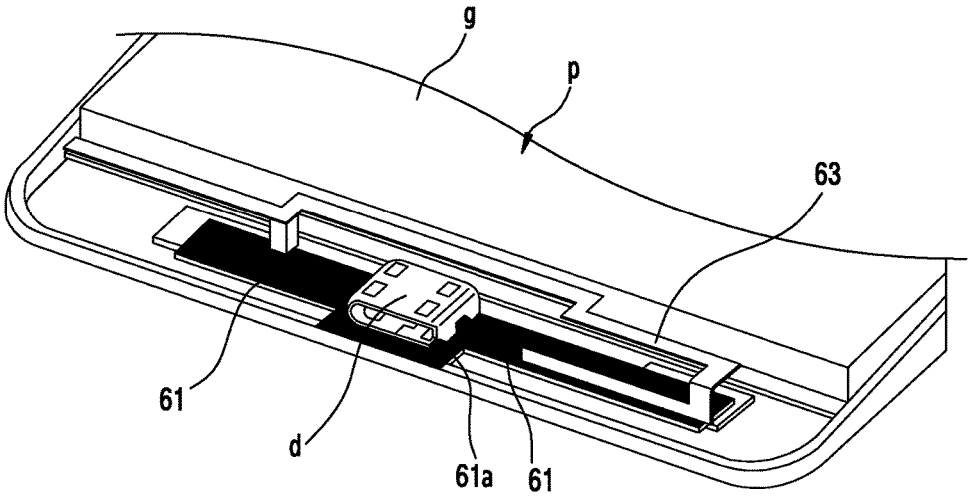
FIG. 9 is a perspective view illustrating an antenna that is provided in an electronic device according to various embodiments of the present disclosure.

FIG. 9 is a perspective view illustrating an antenna that is provided in an electronic device according to various embodiments of the present disclosure. FIG. 10 is a plan view illustrating the antenna shown in FIG. 9 according to various embodiments of the present disclosure.

Figure 10:
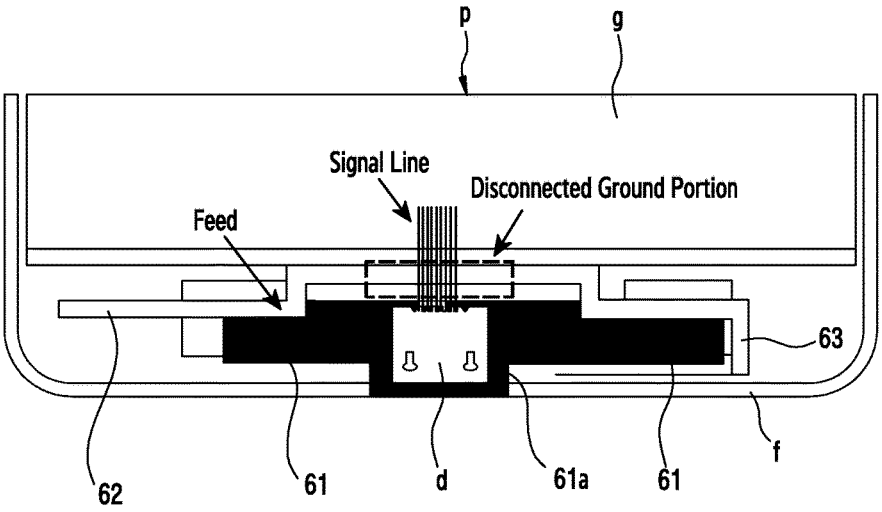
FIG. 10 is a plan view illustrating the antenna shown in FIG. 9 according to various embodiments of the present disclosure.

Referring to FIGS. 9 and 10, according to various embodiments of the present disclosure, an antenna may include one or more radiators 62 and 63, at least one float ground portion 61 that is disconnected from the substrate p, and an external metallic frame f that is connected to the float ground portion 61.

The substrate p is a plate on which a plurality of components are mounted through an SMD process. The substrate p may include a ground face g in at least an area thereof and may typically be configured in a single layer or multiple layers. In addition, an RF unit is mounted on the substrate p, and a power feeding unit is not illustrated in the drawings.

The external metallic frame f may be a metallic housing that forms at least a portion of the exterior of the electronic device, in particular, a portion that encloses the circumference of the side faces of the electronic device (the rim). In addition, the external metallic frame f may be configured in a segmented type or a non-segmented type. Here, the external metallic frame f may be configured in the non-segmented type.

One or more float ground portions 61 (float grounds) may be provided at positions that are disconnected from the substrate p in a space between the substrate p and the external metallic frame f, and may be configured in various shapes. In addition, the float ground portion 61 may be used as radiators to operate as antennas. The float ground portion 61 may be configured by being plated in at least an area of a rigid substrate, or at least an area of a flexible substrate. Further, the float ground portion 61 may be formed of a metal sheet. According to various embodiments of the present disclosure, the float ground portion 61 may be disconnected from the substrate p, and may be connected to the external metallic frame f. The float ground portion 61 may be electrically connected to the external metallic frame f through an inductor (L), a capacitor (C), a separate component that may exhibit the effect of the capacitor, a mechanical structure, or the like. When the float ground portion 61 is indirectly electrically connected to the external metallic frame f, a contact terminal, a contact clip, a flexible circuit board, a metallic member, or the like may be used.

The conductive material component d may be disposed on the float ground portion 61, and then may be connected to the external metallic frame f. The conductive material component d may include a USB connector accessory, an ear phone connecting jack connector accessory, a camera module accessory, a receiver accessory, or the like. Here, the conductive material component d may be mounted on the external metallic frame or may be mounted to be spaced apart from the external metallic frame.

The radiator 62 may operate as an antenna radiator upon being fed with power from a power feeding unit that is provided on the substrate p. At least a portion of the radiator may be fed with power from the substrate p on the float ground portion 61 to operate as the antenna radiator, the other portion may be electrically connected with the float ground portion 61.

Upon being fed with power, the radiator 62 may operate as a first band antenna radiator (e.g., a high band antenna radiator), and the external metallic frame f may operate as a second band antenna radiator (e.g., a low band antenna radiator). Accordingly, the antenna may operate as a multi-band antenna. The radiator 62 and the external metallic frame f may have individual antenna patterns for different antenna bands, and the two radiators 62 and f may operate for one band. The float ground portion 61 may apply a current to the external metallic frame f.

A signal line of the USB connector, which is provided in the conductive material component d, may be electrically connected to the substrate p across a region in which the float ground portion 61 does not exist. In addition, the signal line of the USB connector may be electrically connected to the substrate p along the inner wall of the external metallic frame f. For the signal line, a wire or a flexible circuit board may be used. In addition, the conductive material component d may be mounted on the external metallic frame for a region that extends from the external metallic frame using a fastener.

Figure 11:
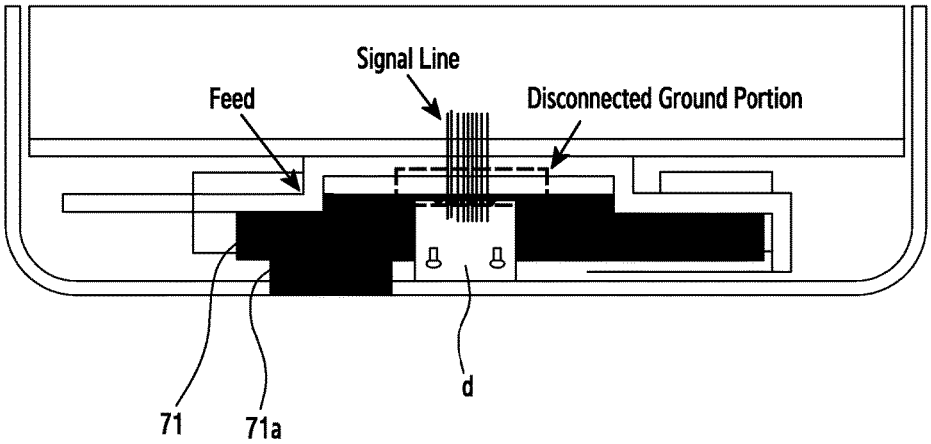
FIG. 11 is a view illustrating an antenna that is provided in an electronic device according to various embodiments of the present disclosure.

FIG. 11 is a view illustrating an antenna that is provided in an electronic device according to various embodiments of the present disclosure.

Referring to FIG. 11, according to various embodiments of the present disclosure, the antenna illustrated here is different from the antenna illustrated in FIG. 10 in terms of configuration. While the float ground portion 61 illustrated in FIG. 10 may include a connecting portion 61*a* that is connected to the external metallic frame f at about a middle portion thereof, the float ground portion 71 illustrated in FIG. 11 may include a connecting portion 71*a* that is connected to the external metallic frame f at a side region. At this time, while the conductive material component d illustrated in FIG. 10 may be disposed on the connecting portion 61*a*, the conductive material component d illustrated in FIG. 11 may not be disposed on the connecting portion 71*a*. The float ground portion 71 and the connecting portion 71*a* may be used as a radiator to operate as an antenna.

Figure 12A:
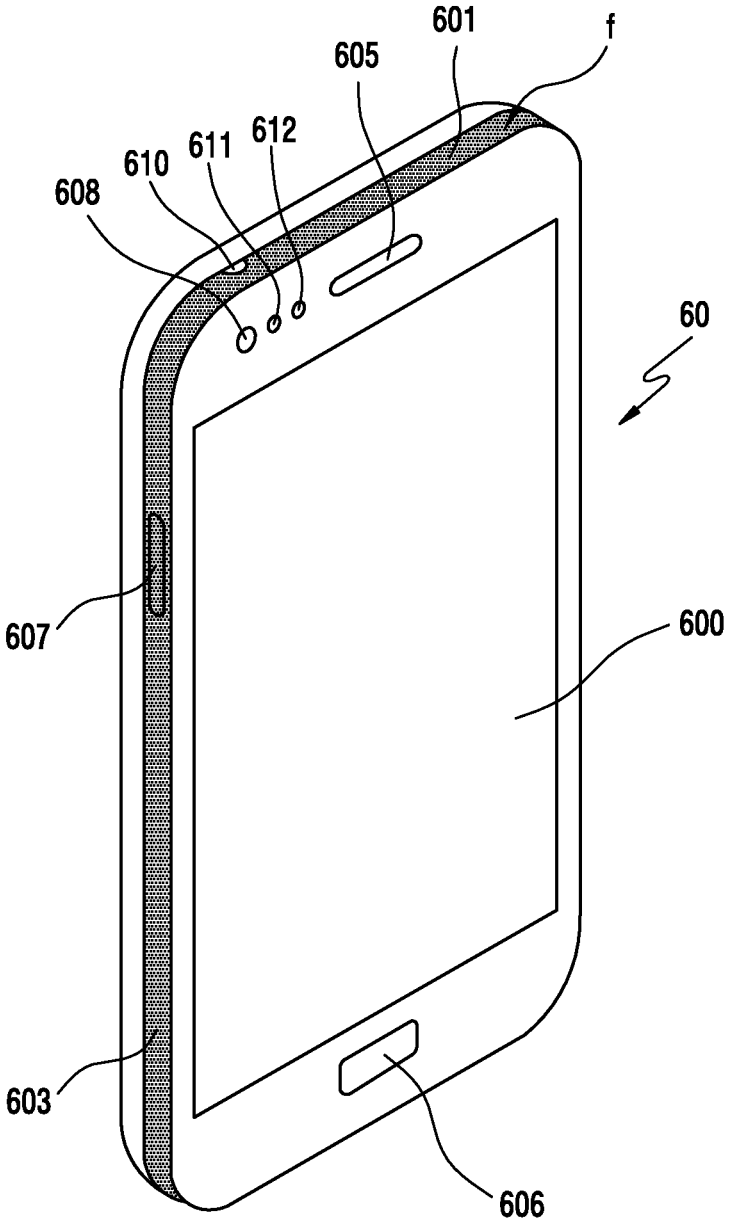
FIG. 12A is a perspective view illustrating a front face of an electronic device according to various embodiments of the present disclosure.
Figure 12B:
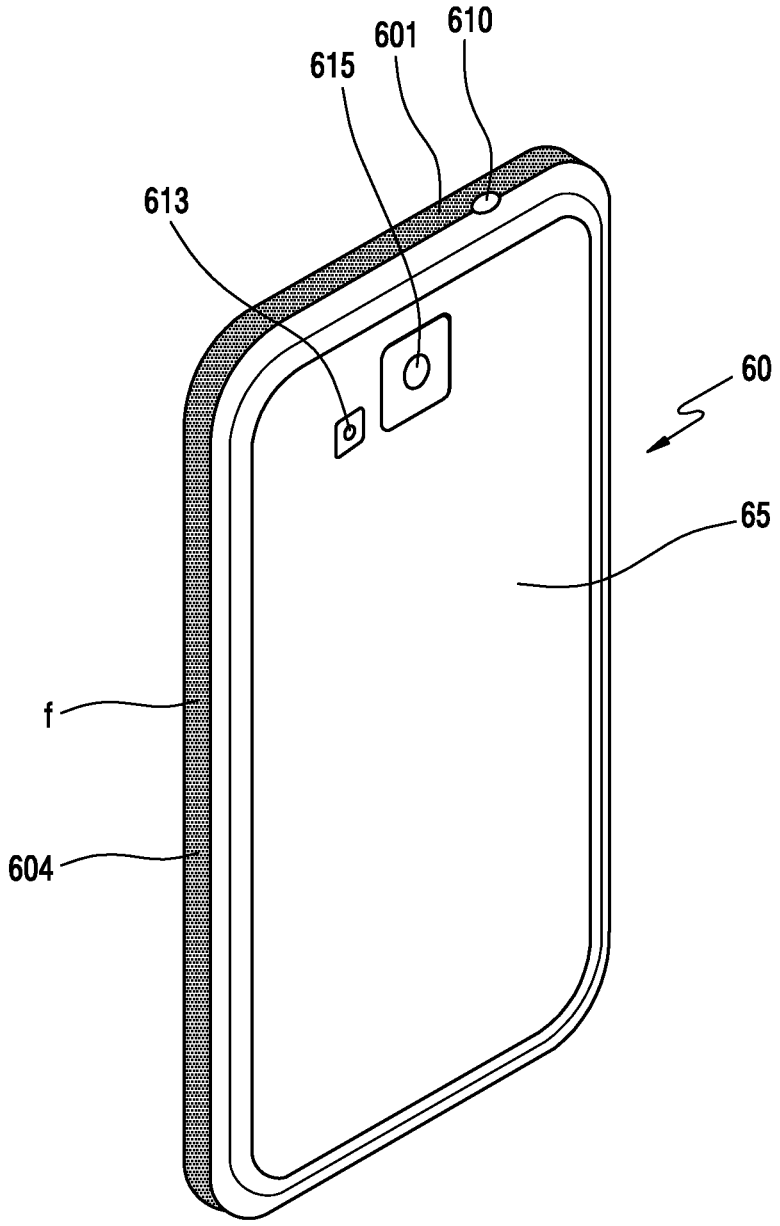
FIG. 12B is a perspective view illustrating a rear face of an electronic device according to various embodiments of the present disclosure.
Figure 12C:
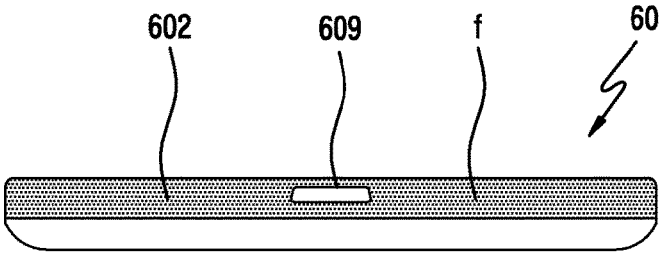
FIG. 12C is a side view illustrating a lower end side face of an electronic device according to various embodiments of the present disclosure.

Referring to FIGS. 12A to 12C, according to various embodiments of the present disclosure, the antenna may be configured by forming the external metallic frame in various shapes.

FIG. 12A is a perspective view illustrating a front face of an electronic device according to various embodiments of the present disclosure. FIG. 12B is a perspective view illustrating a rear face of an electronic device according to various embodiments of the present disclosure. FIG. 12C is a side view illustrating a lower end side face of an electronic device according to various embodiments of the present disclosure Referring to FIGS. 12A to 12C, according to various embodiments of the present disclosure, the electronic device 60 may include a touch screen 600 arranged in the front face, and a battery cover 65 (or a rear cover) arranged in the rear face. The battery cover 65 may be configured to be removable from the electronic device or may be integrally formed with the electronic device. The electronic device 60 may include four side faces. The side faces may include an upper end side face 601, a lower end side face 602, and left and right side faces 603 and 604 between the upper and lower end side faces.

The components, which are equipped with accessories that form the exterior of the electronic device, may include, for example, a speaker 605, a front camera 608, sensors 611 and 612, and a home key 606, which are arranged on the front face of the electronic device 60, a rear camera 615 and a flash 613, which are arranged on the rear face of the electronic device 60, one or more side keys 607, which are arranged on the left side face of the electronic device 60, an earphone connecting jack connector 610, which is arranged on the upper end side face of the electronic device 60, and a USB connector 609, which is arranged on the lower end side face of the electronic device 60. On the side faces 601 to 604 of the electronic device 60, an external metallic frame f may be provided to continuously extend along the side faces 601 to 604.

The external metallic frame f may form a portion or the entirety of the external accessory that encloses the side faces of the housing of the electronic device. The external metallic frame f may extend to enclose the upper and lower end side faces 601 and 602, and the left and right side faces 603 and 604 with a uniform thickness, and may extend with a uniform width. In addition, the external metallic frame f may extend to enclose the upper and lower end side faces, and the left and right side faces with a non-uniform thickness, and may extend with a uniform width. The width may refer to a length in the thickness direction of the electronic device. The external metallic frame f may be provided in a segmented or non-segmented structure.

Figure 13A:
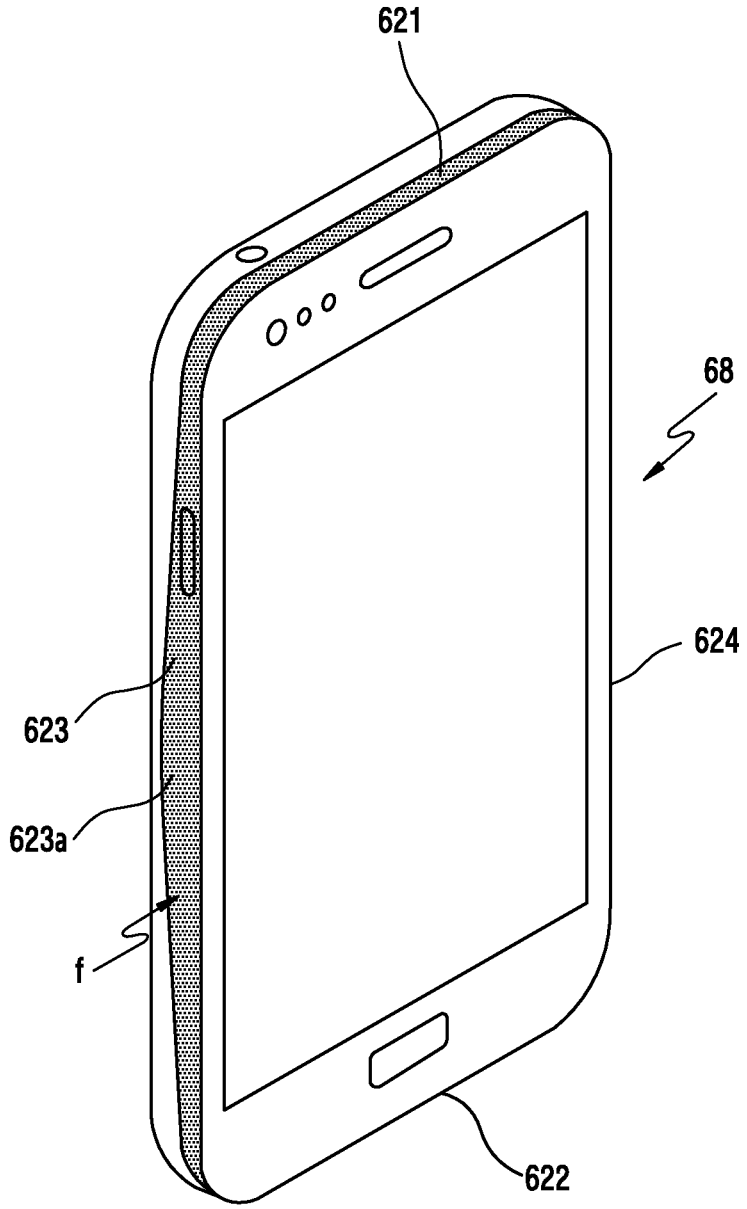
FIG. 13A is a perspective view illustrating a front face of an electronic device according to various embodiments of the present disclosure.
Figure 13B:
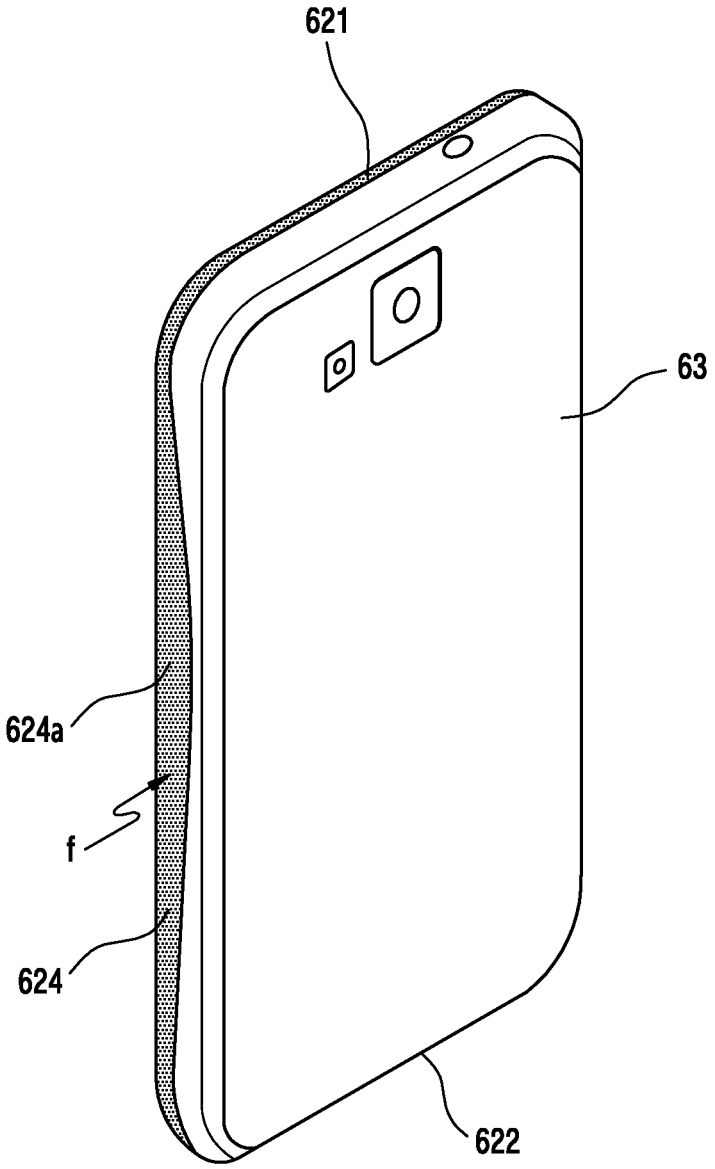
FIG. 13B is a perspective view illustrating a rear face of an electronic device according to various embodiments of the present disclosure.
Figure 13C:
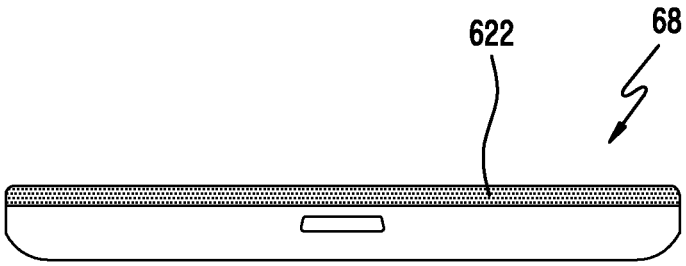
FIG. 13C is a side view illustrating a lower end side face of an electronic device according to various embodiments of the present disclosure.

FIG. 13A is a perspective view illustrating a front face of an electronic device according to various embodiments of the present disclosure. FIG. 13B is a perspective view illustrating a rear face of an electronic device according to various embodiments of the present disclosure. FIG. 13C is a side view illustrating a lower end side face of an electronic device according to various embodiments of the present disclosure.

Referring to FIGS. 13A to 13C, according to various embodiments of the present disclosure, the external metallic frame f may form a portion or the entirety of the external accessory that encloses the side faces of the electronic device 68. The external metallic frame f may extend to enclose the upper and lower end side faces and the left and right side faces with a uniform thickness or a non-uniform thickness, and may extend with a non-uniform width. The width may refer to a length in the thickness direction of the electronic device. The external metallic frame f may have a width that is narrow on the upper and lower end faces 621 and 622 and gradually increases toward the left and right side faces 623 and 624. In particular, the central regions 623*a* and 624*a* of the external metallic frame on the left and right side faces may be formed in a gently convex shape (arch shape). An external metallic frame that is used as an antenna region (the external metallic frame on the upper end side face or the lower end side face) may be configured to have a relatively narrower width than the central regions 623*a* and 624*a* so as to improve the antenna performance or to adjust the antenna performance.

Figure 14:
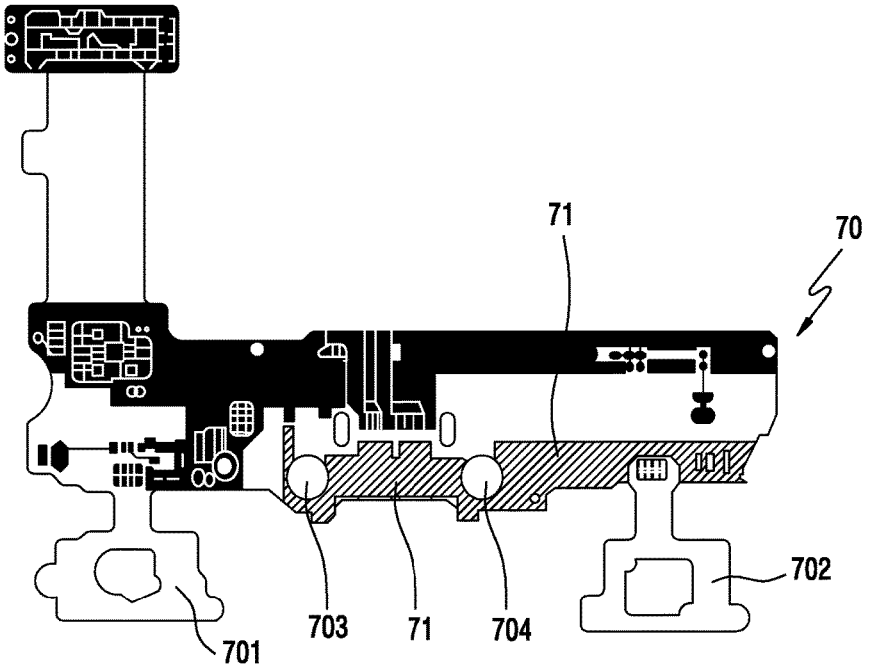
FIG. 14 is a view illustrating a practical float ground portion that is provided in an electronic device according to various embodiments of the present disclosure.

FIG. 14 is a view illustrating a practical float ground portion that is provided in an electronic device according to various embodiments of the present disclosure Referring to FIG. 14, according to various embodiments of the present disclosure, a float ground portion 71 may be arranged to be disconnected from the substrate, and may be configured on at least a portion of a flexible circuit board 70. The float ground portion 71 may occupy at least a portion of the flexible circuit board 70, and may be fabricated in a layer shape by plating a least a portion of the flexible circuit board 70. Portions 701 and 702, each of which extends from the flexible circuit board 70 having the float ground portion, may be a flexible circuit board on which a touch key is disposed. In addition, two circular openings 703 and 704 are formed in the float ground portion 71. Each of the openings 703 and 704 may be holes, through which a fastener (e.g., a screw) for mounting a conductive material component (e.g., a USB connector accessory) passes.

Figure 15:
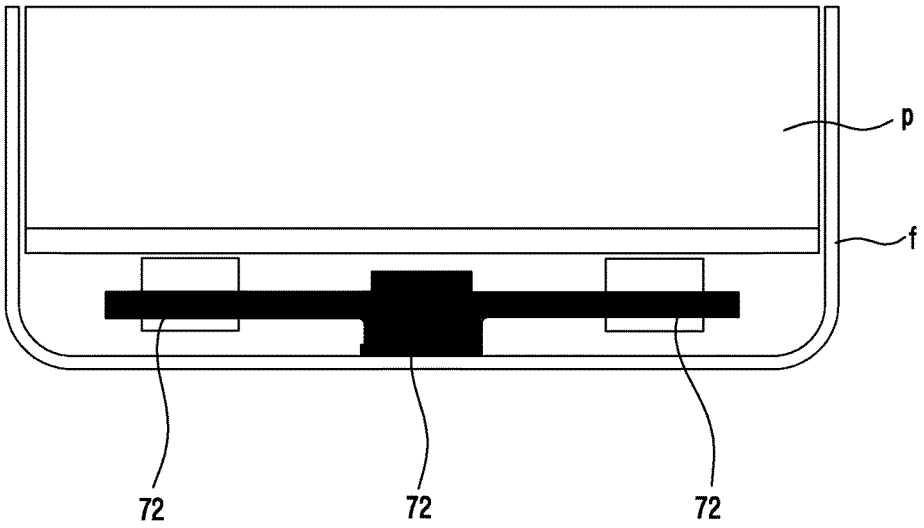
FIG. 15 is a view illustrating an arrangement state of a float ground portion that is provided in an electronic device according to various embodiments of the present disclosure.

FIG. 15 is a view illustrating an arrangement state of a float ground portion that is provided in an electronic device according to various embodiments of the present disclosure Referring to FIG. 15, according to various embodiments of the present disclosure, the float ground portion 72 may be at least partially disposed on the internal bracket. In addition, the float ground portion 72 may be at least partially connected to the internal bracket. According to various embodiments of the present disclosure, the float ground portion 72 may be at least partially connected to the external metallic frame f. The connection state is an electric connection. The substrate P may be configured as a rigid substrate, and the float ground portion 72 may be configured as a flexible substrate. The float ground portion 72 may be provided in various patterns on the flexible circuit board, and may be arranged to be disconnected from the substrate p and to be connected to the external metallic frame f. A conductive material component may be disposed in the central region of the float ground portion 72. The float ground portion 72 may be used as a radiator to operate as an antenna.

Figure 16:
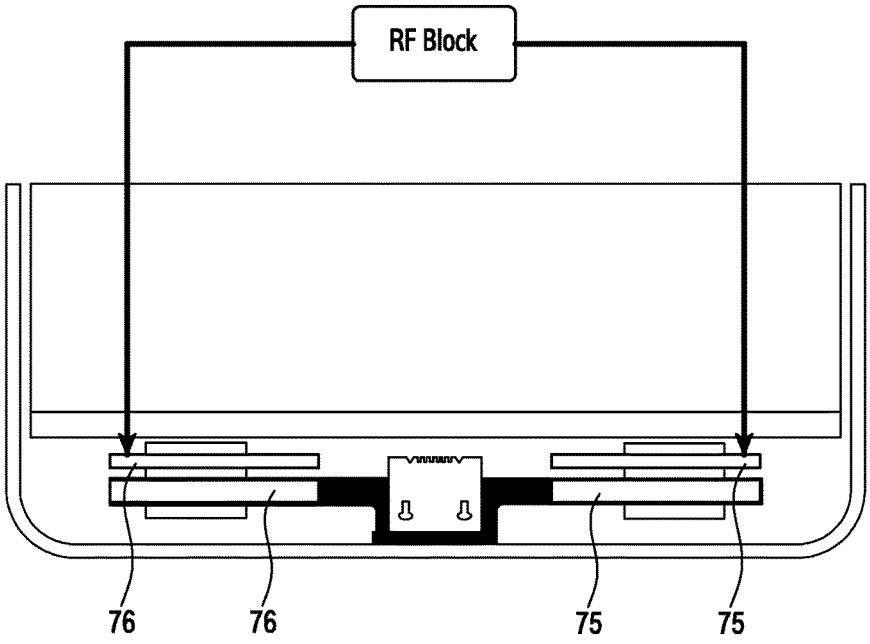
FIG. 16 is a view illustrating a plurality of antennas that are employed in an electronic device according to various embodiments of the present disclosure.

FIG. 16 is a view illustrating a plurality of antennas that are employed in an electronic device according to various embodiments of the present disclosure.

Referring to FIG. 16, according to various embodiments of the present disclosure, a plurality of radiates 75 and 76 that operate as an antenna may be provided.

For example, upon gripping the electronic device, a user may grip the electronic device by the left hand or the right hand, and when radiation degradation of one antenna radiator 75 is sensed, switching to another antenna radiator 76 is performed so that the antenna radiator 76 may be used. The antenna is provided a power feeding switch so that one of the antenna radiators 75 and 76 may be selectively operated as the antenna radiator. The power feeding switch is not illustrated.

Figure 17:
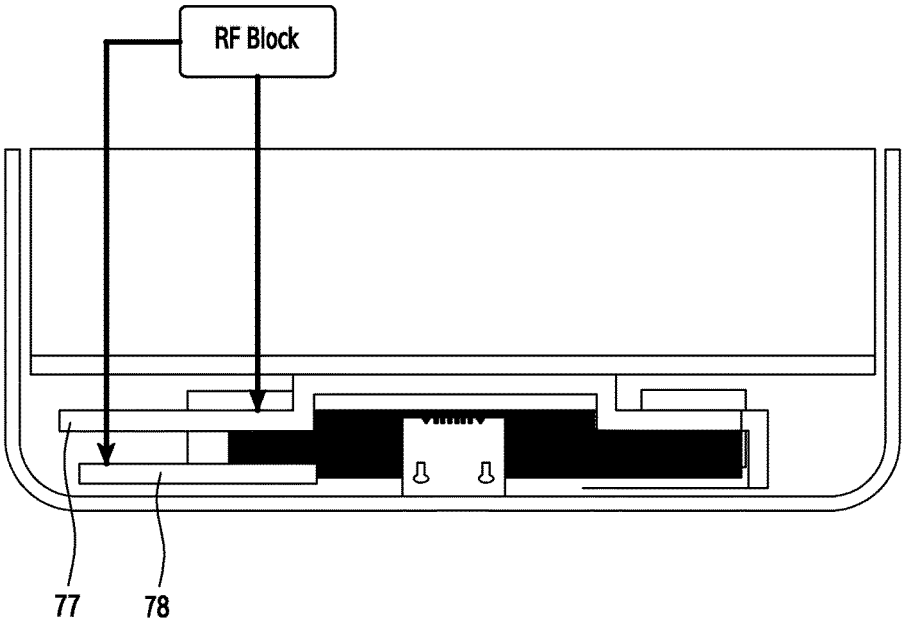
FIG. 17 is a view illustrating a plurality of antennas that are employed in an electronic device according to various embodiments of the present disclosure.

FIG. 17 is a view illustrating a plurality of antennas that are employed in an electronic device according to various embodiments of the present disclosure.

Referring to FIG. 17, according to various embodiments of the present disclosure, a plurality of radiators 77 and 78, which operate as an antenna, may be provided. The antenna may be used as a plurality of antennas simultaneously by arranging the plurality of antennas and assigning a band to each of the radiators 77 and 78. In addition, the antenna may be provided with a power feeding switch and one of the antenna radiators 77 and 78 may be connected to be fed with power so that the antenna radiators may be selectively operated.

Descriptions will be made on an arrangement of a float ground portion of an antenna according to various embodiments of the present disclosure with reference to FIGS. 18 to 22.

Figure 18:
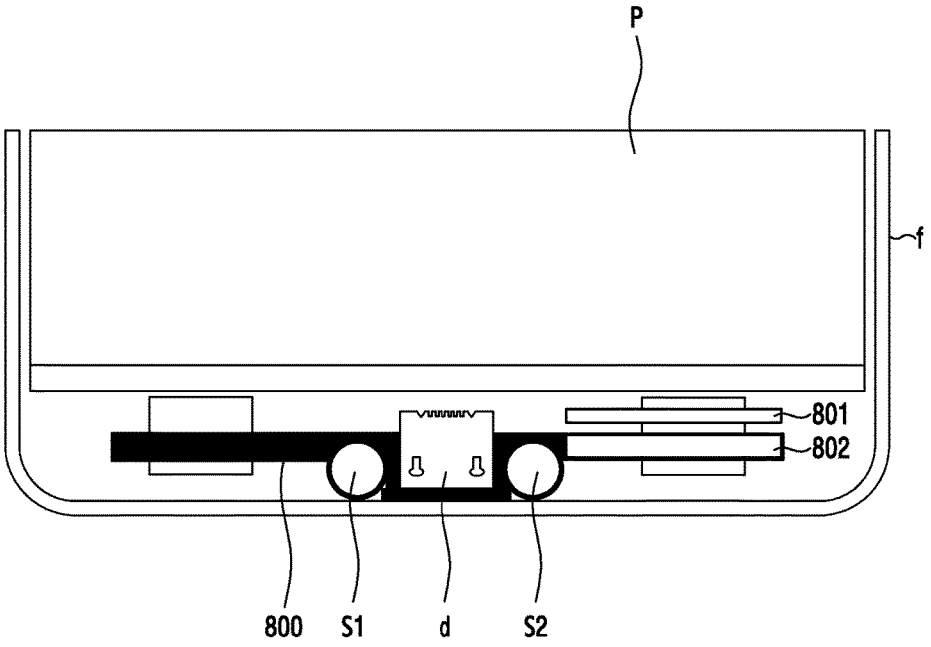
FIG. 18 is a view illustrating an antenna that is provided in an electronic device according to various embodiments of the present disclosure.

FIG. 18 is a view illustrating an antenna that is provided in an electronic device according to various embodiments of the present disclosure.

Referring to FIG. 18, according to various embodiments of the present disclosure, a float ground portion 800 of an antenna may be connected to an external metallic frame using one or more metallic screws S1 and S2. The screws S1 and S2 may be vertically fastened so as to electrically connect the float ground portion 800 to the external metallic frame f, and may fix the conductive material component d onto an internal bracket. A conductive material component d (e.g., a housing that forms the exterior of a USB connector) may be connected to the external metallic frame by the screws S1 and S2. The conductive material component d may be supported on an abutment, which is provided on the internal bracket or the external metallic frame f by fastening the screws S1 and S2 on the left and right of the conductive material component d. One or more antenna patterns 801 and 802 (metallic bodies) may be provided in a side region of the float ground portion 800 to be electrically conductive with each other. The float ground portion 800 may be used as a radiator to operate as an antenna.

Figure 19:
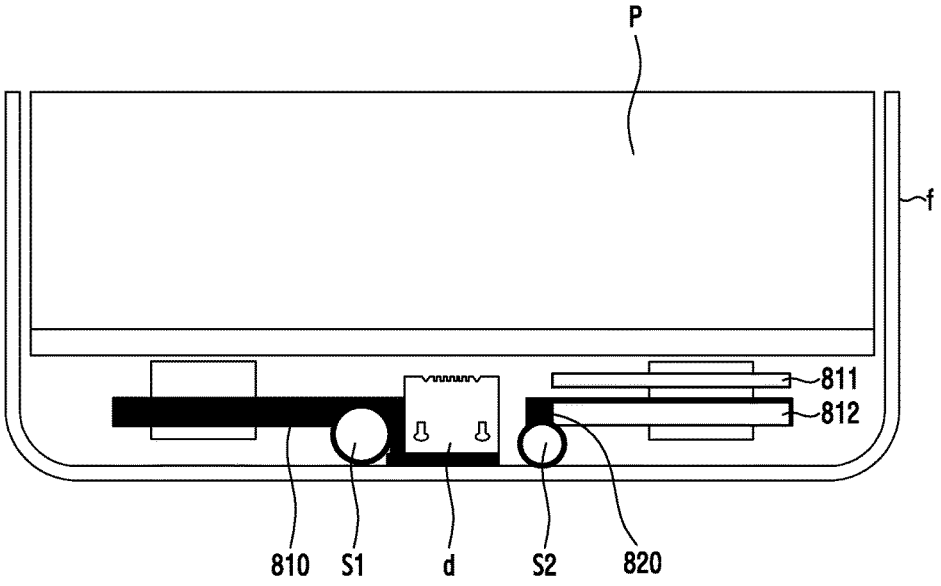
FIG. 19 is a view illustrating an antenna that is provided in an electronic device according to various embodiments of the present disclosure.

FIG. 19 is a view illustrating an antenna that is provided in an electronic device according to various embodiments of the present disclosure.

Referring to FIG. 19, according to various embodiments of the present disclosure, one or more float ground portions 810 and 820 of an antenna may be connected to an external metallic frame f using a metallic screw S1 or a metallic body S2. The float ground portions may include a first float ground portion 810 that is arranged to be disconnected from the substrate p, and a second float ground portion 820 that is arranged to be disconnected from the substrate p and the first float ground portion 810. The first float ground portion 810 may be directly connected to the external metallic frame f. The first float ground portion 810 may include a conductive material component d that is disposed thereon. The second float ground portion 820 may be electrically connected to the external metallic frame using a metallic body, such as a contact terminal, a contact clip, a metallic sheet, or a conductive tape. On the second float ground portion 820, one or more radiators 811 and 812 (metallic bodies) may be arranged to be electrically conductive with each other.

In addition, the first float ground portion 810 may be coupled to the internal bracket and/or the external metallic frame f using a first metallic fastener S1, such as a first screw. The second float ground portion 820 may be connected to the external metallic frame f using a second metallic fastener S2, such as a contact terminal, a contact clip, a metal sheet, or a conductive tape. Each of the float ground portions 810 and 820 may be used as a radiator to operate as an antenna.

Figure 20:
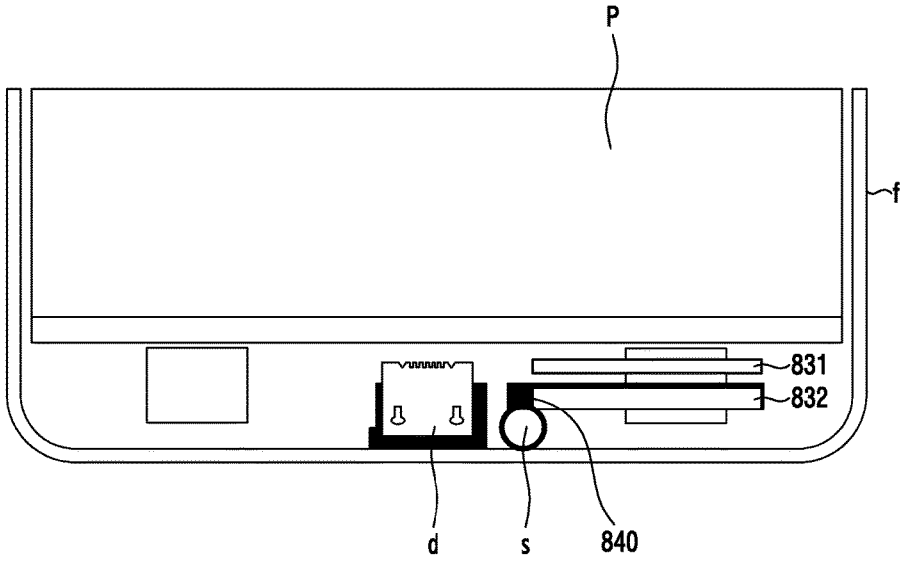
FIG. 20 is a view illustrating an antenna that is provided in an electronic device according to various embodiments of the present disclosure.

FIG. 20 is a view illustrating an antenna that is provided in an electronic device according to various embodiments of the present disclosure.

Referring to FIG. 20, according to various embodiments of the present disclosure, a float ground portion 840 of an antenna may be connected to an external metallic frame f using a conductor s. The float ground portion 840 may be arranged to be disconnected from the substrate P. The float ground portion 840 may be connected to the external metallic frame f directly or indirectly. The float ground portion 840 may be electrically connected to the external metallic frame f using a conductor s, such as a contact terminal, a contact clip, a metal sheet, or a conductive tape. On the float ground portion 840, one or more antenna patterns 831 and 832 (metallic bodies) may be arranged. The conductive material component d (e.g., a housing that forms the exterior of an USB connector) may be fixed to an internal bracket or an abutment that is provided on the external metallic frame f. The float ground portion 840 may be used as a radiator to operate as an antenna.

Figure 21:
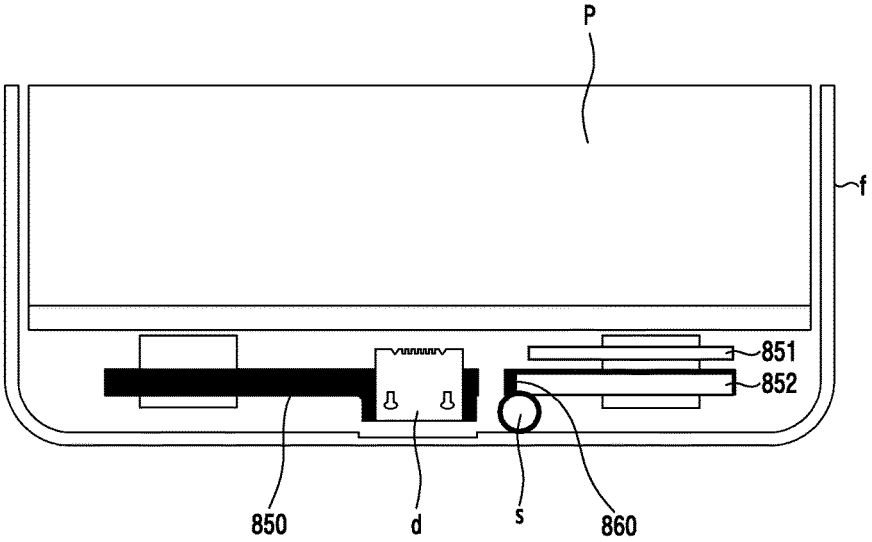
FIG. 21 is a view illustrating an antenna that is provided in an electronic device according to various embodiments of the present disclosure.

FIG. 21 is a view illustrating an antenna that is provided in an electronic device according to various embodiments of the present disclosure.

Referring to FIG. 21, according to various embodiments of the present disclosure, one or more float ground portions 850 and 860 of an antenna may be electrically connected to an external metallic frame f using a conductor s. The float ground portions may include a first float ground portion 850 that is arranged to be disconnected from the substrate P and a second float ground portion 860 that is arranged to be disconnected from the substrate P and the first float ground portion 850. The first float ground portion 850 may be arranged to be disconnected from the external metallic frame f. On the first float ground portion 850, a conductive material component d may be arranged. On the second float ground portion 860, one or more radiators 851 and 852 (metallic bodies) may be arranged.

The first float ground portion 850 is arranged to be disconnected from the substrate P and the external metallic frame f, and to be connected to the conductive material component d. The second float ground portion 860 may be electrically connected to the external metallic frame f using a conductor s, such as a contact terminal, a contact clip, a metal sheet, or a conductive tape. The conductive material component d (e.g., a housing that forms the exterior of a USB connector) may be arranged on the first float ground portion 850 to be electrically connected thereto. Each of the float ground portions 850 and 860 may be used as a radiator to operate as an antenna.

Figure 22:
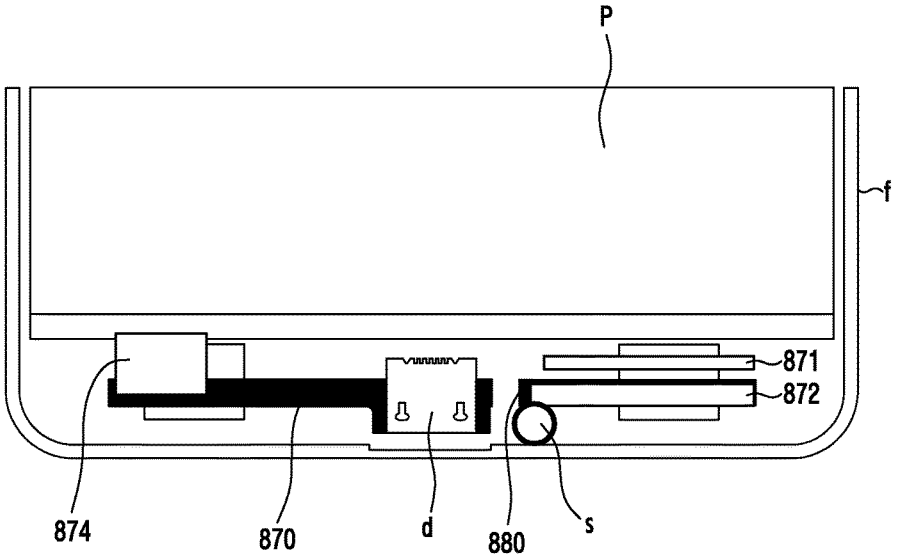
FIG. 22 is a view illustrating an antenna that is provided in an electronic device according to various embodiments of the present disclosure.

FIG. 22 is a view illustrating an antenna that is provided in an electronic device according to various embodiments of the present disclosure.

Referring to FIG. 22, according to various embodiments of the present disclosure, one of float ground portions 870 and 880 of an antenna may be connected to an external metallic frame f using a conductor s. The float ground portions may include a first float ground portion 870 that is arranged to be disconnected from the external metallic frame f, and a second float ground portion 880 that is arranged to be disconnected from the substrate P and the first float ground portion 870. The first float ground portion 870 may be arranged to be disconnected from the external metallic frame f, but to be electrically connected to a substrate P by a connecting portion 874. On the first float ground portion 870, a conductive material component d may be arranged. On the second float ground portion 880, one or more radiators 871 and 872 (metallic bodies) may be arranged to operate as an antenna.

The first float ground portion 870 may be arranged to be disconnected from the external metallic frame f and to be connected to the conductive material component d. The second float ground portion 880 may be connected to the external metallic frame f using a conductor, such as a metallic screw, a contact terminal, a contact clip, a metal sheet, or a conductive tape. The conductive material component d (e.g., a housing that forms the exterior of a USB connector) may be arranged on the first float ground portion 870. Each of the float ground portions 870 and 880 may be used as a radiator to operate as an antenna.

Descriptions will be made on a configuration to isolate antennas in an electronic device that is equipped with a plurality of antennas according to various embodiments of the present disclosure referring to FIGS. 23 to 26.

Figure 23:
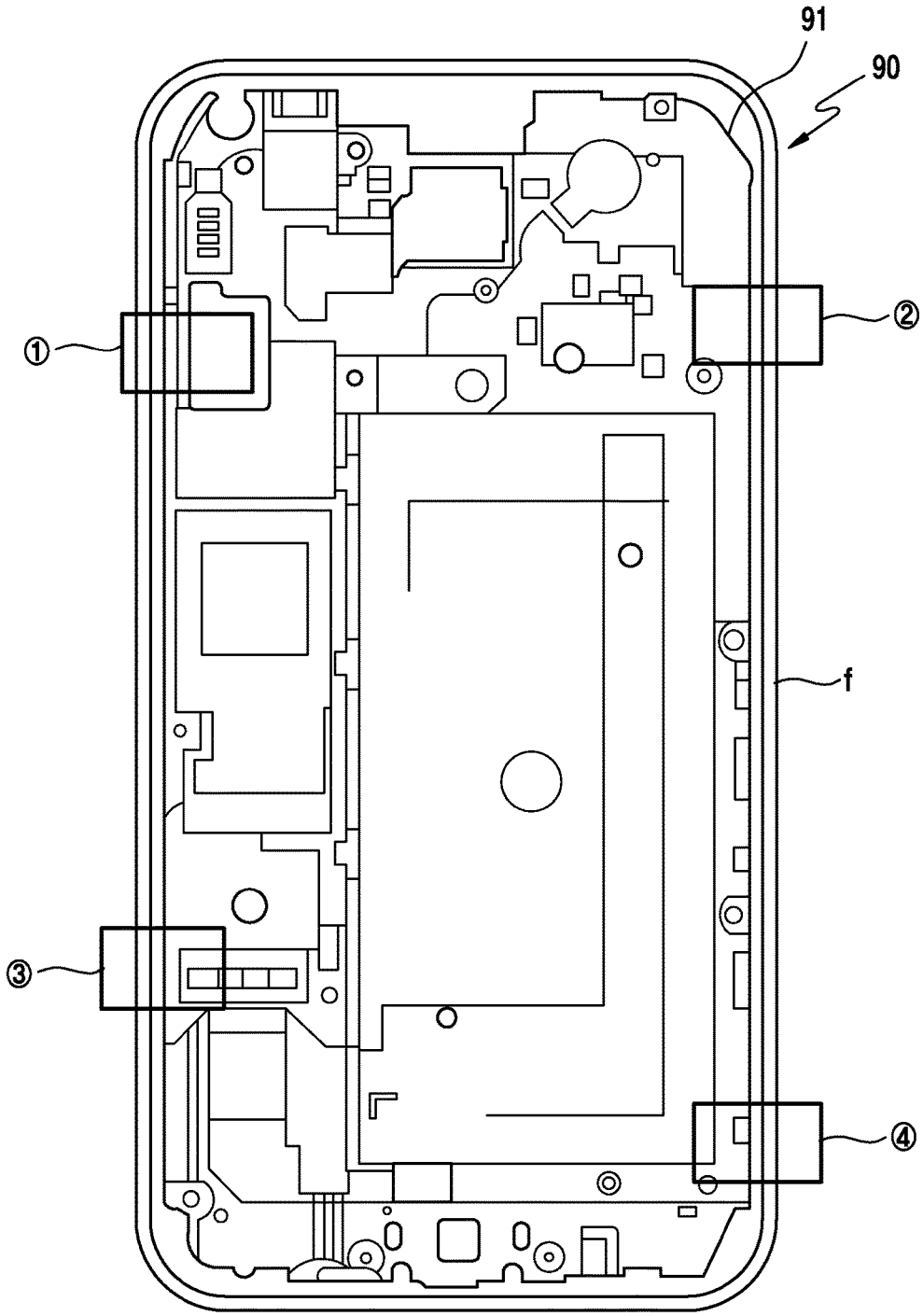
FIG. 23 is a view illustrating an internal bracket of an electronic device according to various embodiments of the present disclosure.

FIG. 23 is a view illustrating an internal bracket of an electronic device according to various embodiments of the present disclosure.

Referring to FIG. 23, according to various embodiments of the present disclosure, an electronic device 90 may include a plurality of antennas that are arranged in the upper end region or the lower end region. An external metallic frame f may be a non-segmented type and may be arranged to enclose the periphery of a substrate and an internal bracket 91. The electronic device 90 may include one or more antenna members that are mainly arranged in each of the upper end left region and the upper end right region, or in each of the lower end left region and the lower end right region.

However, in order to prevent a short circuit between respective antennas, the internal bracket 91 and the external metallic frame f may be configured to secure a capacitance in a face-to-face type rather than in a direct connection. The face-to-face type structure may be applied to at least one of first to fourth regions ① to ④ of the electronic device.

A plurality of metallic members arranged on the exterior of the electronic device and/or within the electronic device may be used as elements for resonance of an antenna. According to one embodiment, an annular external metallic frame that forms the exterior of the electronic device and internal metallic product arranged within the electronic device (e.g., a bracket, a PCB ground, a radiator, a pattern) may be electrically connected to each other at one or more locations to be implemented as an additional ground body for the antenna. A current fed to the antenna may be circulated along a radiation pattern of the antenna, and may be introduced into the ground of the substrate, a component containing a conductive material, thereby forming a transmission line, which is capable of transmitting/receiving wireless electromagnetic waves.

Meanwhile, the resonance frequency of the antenna may be varied depending on an electrical connection position between a component containing a conductive material and a metallic bracket, or the number thereof, and may be deviated from a standard requested for the electronic device (e.g., mismatch). In order to acquire a desired resonance frequency to solve the problems, the antenna may be additionally provided with various antenna matching circuits (e.g., a lumped element, a filter, and a direct short). According to an embodiment, such an antenna matching circuit may be applied to an electrical connecting portion between the component containing the conductive material and the metallic bracket (including the first to fourth regions ① to ④) so that various ground forms for antenna tuning may be applied.

Figure 24:
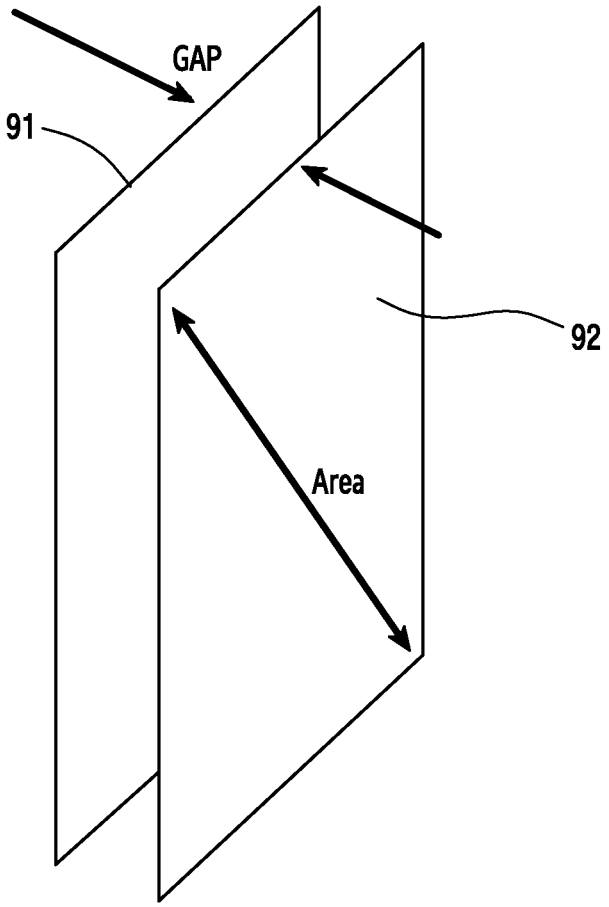
FIG. 24 is a view illustrating a configuration for acquiring a specific capacitance according to a gap and an area between an internal bracket and an external metallic frame according to various embodiments of the present disclosure.

FIG. 24 is a view illustrating a configuration for acquiring a specific capacitance according to a gap and an area between an internal bracket and an external metallic frame according to various embodiments of the present disclosure.

Referring to FIG. 24, it is possible to secure a specific capacitance value by adjusting the gap between the faces of the internal bracket 91 and the external metallic frame 92 or the area of the faces that face each other. The above-described configuration may be partially applied to a region between the internal bracket 91 and the external metallic frame 92. The configuration may be applied to each or all of the first to fourth regions ① to ④ in FIG. 23.

Figure 25:
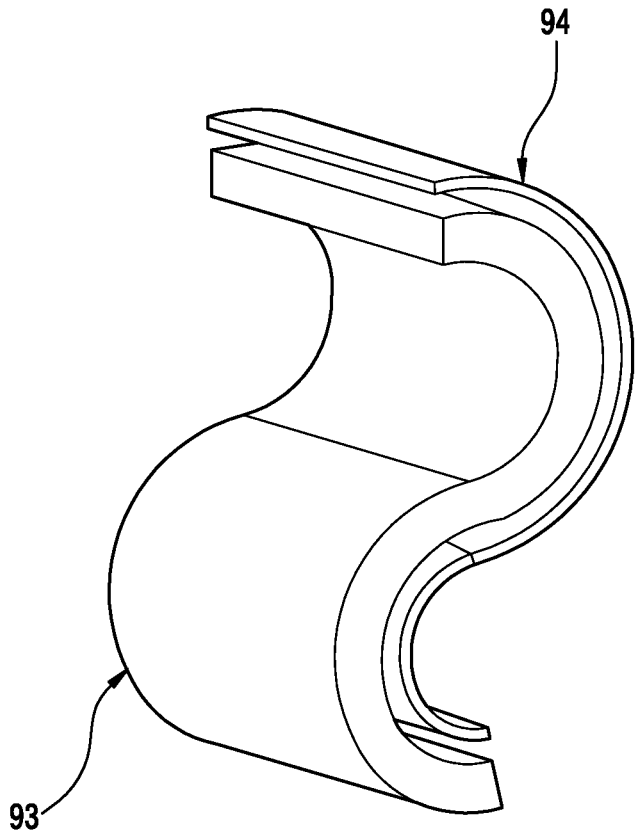
FIG. 25 is a view illustrating a configuration for acquiring a specific capacitance according to a gap and an area between an internal bracket and an external metallic frame according to various embodiments of the present disclosure.

FIG. 25 is a view illustrating a configuration for acquiring a specific capacitance according to a gap and an area between an internal bracket and an external metallic frame according to various embodiments of the present disclosure.

Referring to FIG. 25, each of the faces that face each other between the internal bracket 93 and the external metallic frame 94 may be configured as a curved face while maintaining a predetermined gap. In addition, the faces that face each other may be configured in a convex shape, a concave shape, or a combination thereof.

Figure 26:
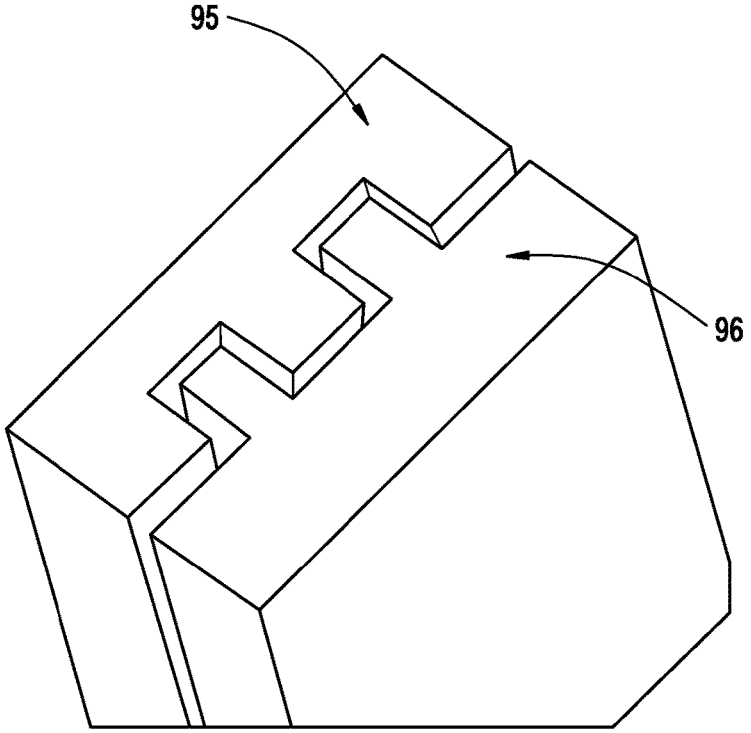
FIG. 26 is a view illustrating a configuration for acquiring a specific capacitance according to a gap and an area between an internal bracket and an external metallic frame according to various embodiments of the present disclosure.

FIG. 26 is a view illustrating a configuration for acquiring a specific capacitance according to a gap and an area between an internal bracket and an external metallic frame according to various embodiments of the present disclosure.

Referring to FIG. 26, the faces that face each other between the internal bracket 95 and the external metallic frame 96 may be configured in concave and convex shapes while maintaining a predetermined gap. In addition, the faces that fact to each other may include one or more concave portions and convex portions which are alternately arranged.

Figure 27:
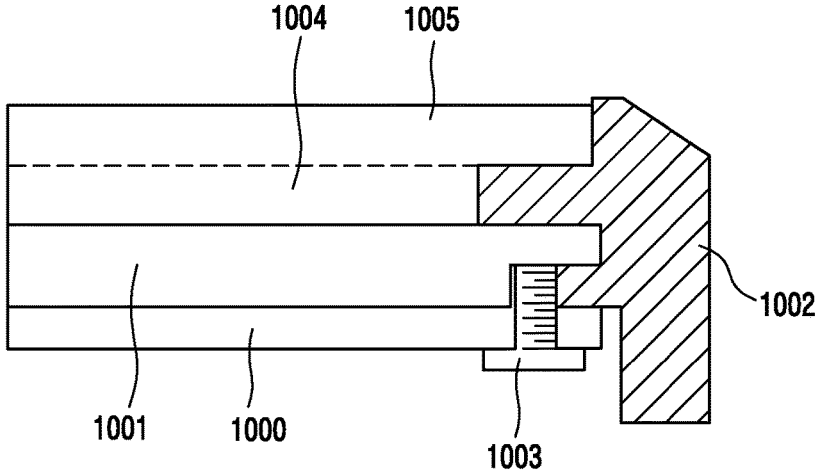
FIG. 27 is a view illustrating a ground structure of a substrate that is provided in an electronic device according to various embodiments of the present disclosure.

FIG. 27 is a view illustrating a ground structure of a substrate that is provided in an electronic device according to various embodiments of the present disclosure.

Referring to FIG. 27, the electronic device may include a display unit 1004 and a window 1005 that are mounted on one face of an internal bracket 1001, and a substrate 1000 that is mounted on the other surface of the internal bracket 1001, and an external metallic frame 1002 may be coupled to enclose the side faces of the internal bracket 1001. The internal bracket 1001 may be made of an injection molded material, a metallic material, or a combination thereof. In order to prevent electric shock, the substrate ground portion may be insulated or disconnected from a screw 1003, and the internal bracket 1001 may also be implemented by an injection molded material. The detailed description of a coupling structure between the external metallic frame 1002 and the internal bracket 1001 will be omitted.

The internal bracket 1001 may serve to support various components, modules, or the like that are equipped in the electronic device. The display unit 1004 may be arranged on and supported by the top face of the internal bracket 1001. On the display unit 1004, a window (e.g., a transparent member, such as a tempered glass) may be bonded. On the bottom face of the internal bracket 1001, the substrate 1000 may be arranged. In addition, the external metallic frame 1002 may be coupled to the internal bracket 1001 so as to support the substrate 1000, the display unit 1004, or the like.

In the structure as described above, the substrate 1000 may be connected to the internal bracket 1001 and the external metallic frame 1002 using a metallic fastener, such as a screw 1003. The screw 1003 is coupled to a ground portion of the substrate 1000 (e.g., a ground face that is formed at least a portion of one face) so that the ground portion of the substrate 1000 may be connected to the internal bracket 1001 and/or the external metallic frame 1002.

Figure 28:
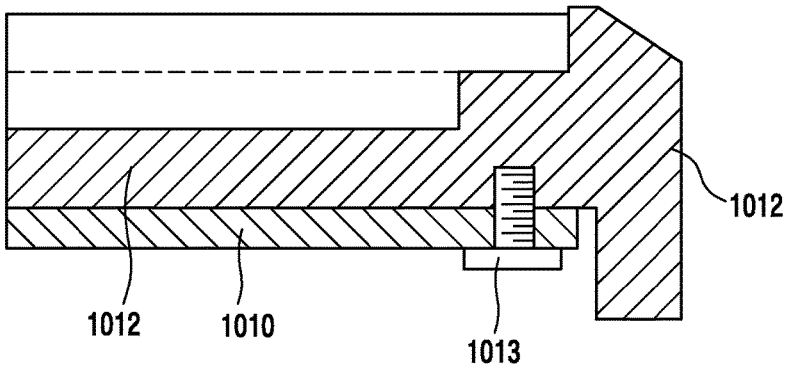
FIG. 28 is a view illustrating a ground structure of a substrate that is provided in an electronic device according to various embodiments of the present disclosure.

FIG. 28 is a view illustrating a ground structure of a substrate that is provided in an electronic device according to various embodiments of the present disclosure.

Referring to FIG. 28, the internal bracket 1001 and the external metallic frame 1002, which are illustrated in FIG. 27, may be integrally formed using the same material. As illustrated in FIG. 28, according to various embodiments of the present disclosure, an internal bracket-external metallic frame 1012 may be made of a metallic material, a light metal alloy, or a combination thereof. In order to prevent electric shock, the substrate ground portion may be insulated or disconnected from the screw 1013, and the internal bracket-external metallic frame 1012 may also be implemented using an injection molding material.

In the structure as described above, the substrate 1010 may be coupled to the internal bracket-external metallic frame 1012 using a metallic fastener, such as the screw 1013. As the screw 1013 is coupled to the ground portion of the substrate 1010 (e.g., a ground face that is formed in at least a portion of one face), the ground portion of the substrate 1010 may be connected to the internal bracket-external metallic frame 1012. In addition, the structure may not have a contact point between the internal bracket and the external metallic frame.

Figure 29:
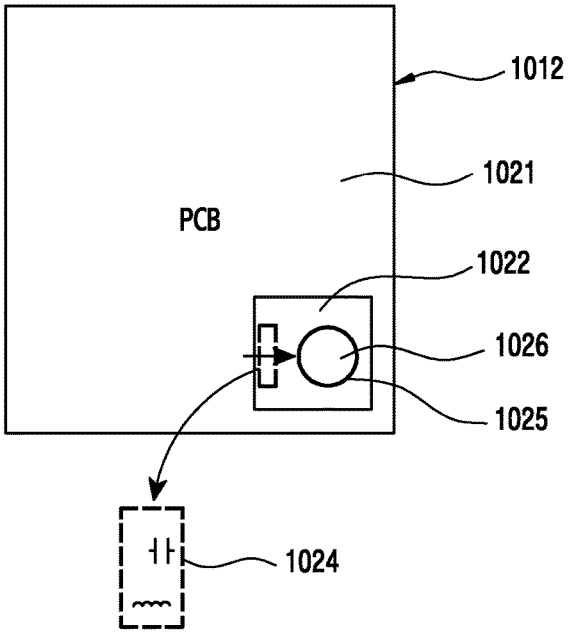
FIG. 29 is a view illustrating a configuration of a substrate for grounding a substrate that is provided in an electronic device according to various embodiments of the present disclosure.

FIG. 29 is a view illustrating a configuration of a substrate for grounding a substrate that is provided in an electronic device according to various embodiments of the present disclosure.

Referring to FIG. 29, according to various embodiments of the present disclosure, a substrate 1021 may be grounded by being fastened to an internal bracket or an external metallic frame using a metallic fastener, such as a screw. The substrate 1021 may include a fastening hole 1026 through which the screw passes, and a ground face 1025 may be formed in a ring shape along the circumference of the fastening hole 1026.

At this time, the substrate fastening hole 1026 may have a fill-cut region 1022 therearound in which the ground face is not formed. For example, the ground face 1025 and the fastening hole 1026 of the substrate may be arranged in a disconnected state by the fill-cut region 1022. At least one electric device 1024 may be additionally inserted into the fill-cut region 1022 to interconnect the ground face 1025 and the fastening hole 1026. The electric device 1024 may be arranged as a ground short, a passive device, an active device, or a combination thereof.

With the above-mentioned configuration, the electric shock of the electronic device may be prevented in advance. An alternating current (AC) power source included in the ground face 1025 of the substrate may reduce the amount of AC that is filtered and coupled through the electric device 1024 so as to prevent the electric shock state of the electronic device.

In addition, according to various embodiments of the present disclosure, in the case where the power feeding line of the antenna is connected to the external metallic frame using the screw, when, among the electric device 1024 and a layer of a multi-layered substrate, only the directly contacted layer floats to generate coupling, the frequency or the input impedance of the antenna may be changed.

Figure 30:
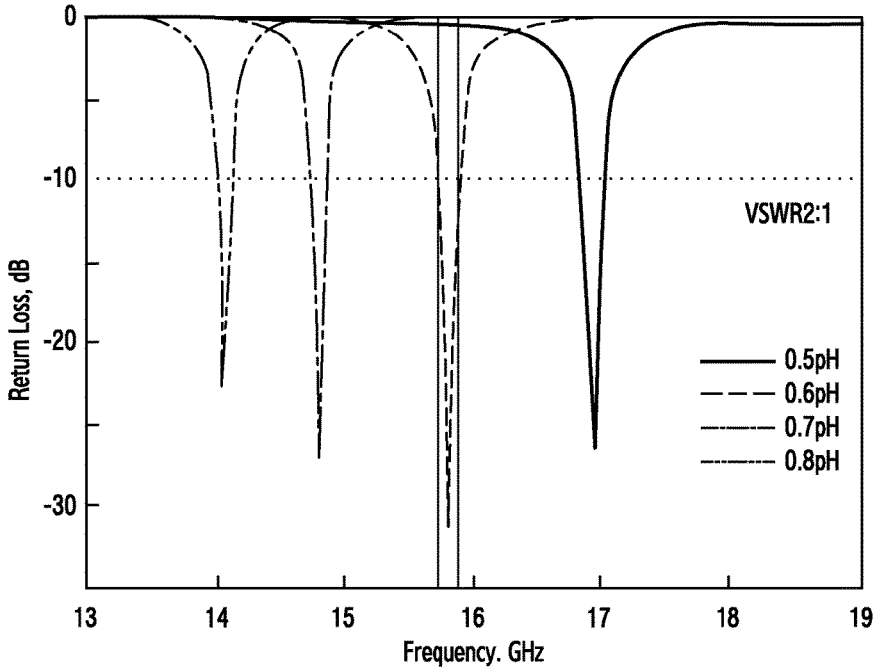
FIG. 30 is a graph illustrating a simulation result of an impedance change and a frequency change of an antenna in a case where, in a state where a section of an exterior of an electronic device according to various embodiments of the present disclosure is used as an antenna, the section is connected with a screw and an inductor is inserted between the screw and a substrate ground face.

FIG. 30 is a graph illustrating a simulation result of an impedance change and a frequency change of an antenna in a case where, in a state where a section of an exterior of an electronic device according to various embodiments of the present disclosure is used as an antenna, the section is connected with a screw and an inductor is inserted between the screw and a substrate ground face.

Figure 31:
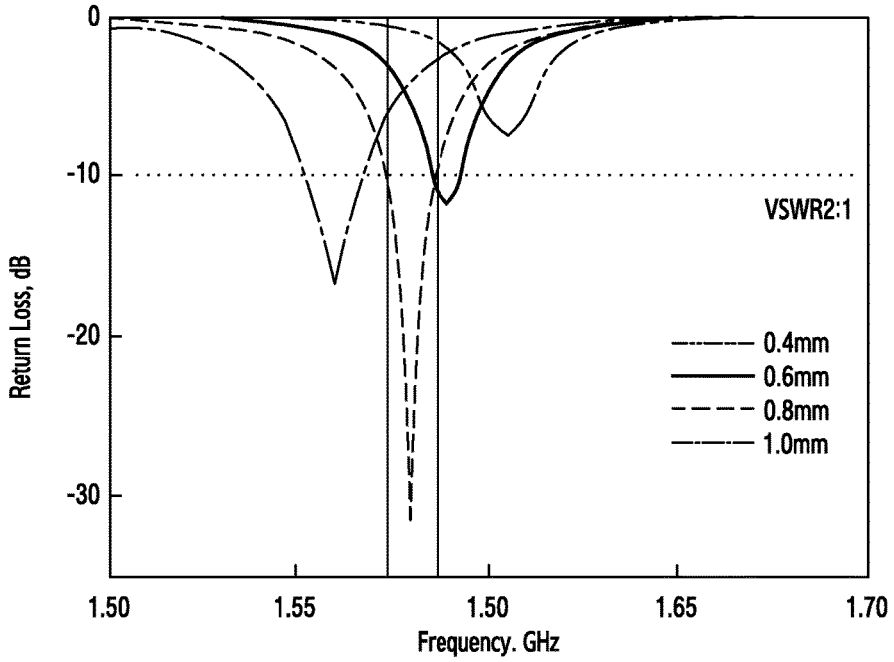
FIG. 31 is a graph illustrating a simulation result of impedance change and frequency change of an antenna in a case where, in a state where a section of an exterior of an electronic device according to various embodiments of the present disclosure is used as an antenna, the section is connected with a screw and the screw is floated with a layer of a portion of the substrate to be electrically coupled.

Referring to FIG. 30, the graph illustrates a simulation result of impedance change and frequency change of an antenna in a case where, in a state where a section of an exterior of an electronic device according to various embodiments of the present disclosure is used as an antenna, the section is connected with a screw and an inductor is inserted between the screw and a substrate ground face;

FIG. 31 is a graph illustrating a simulation result of impedance change and frequency change of an antenna in a case where, in a state where a section of an exterior of an electronic device according to various embodiments of the present disclosure is used as an antenna, the section is connected with a screw and the screw is floated with a layer of a portion of the substrate to be electrically coupled.

Referring to FIG. 31, the graph illustrates a simulation result of impedance change and frequency change of an antenna in a case where, in a state where a section of an exterior of an electronic device according to various embodiments of the present disclosure is used as an antenna, the section is connected with a screw and the screw is floated with a layer of a portion of the substrate to be electrically coupled.

In addition, in the case where a section of a conductor, which forms a portion of the exterior of the electronic device and is exposed to the outside, is used as a key, as a key recognition IC of the substrate and the screw are interconnected and the key recognition IC is connected to the external conductor through the screw, the key including the conductor generates an electric change so that the key can be recognized.

In addition, when a portion of the conductor is used as a key, when the conductor is touched (body contact), a portion of the conductor can be connected to an IC of the internal substrate so that an electric change can be confirmed.

Figure 32A:
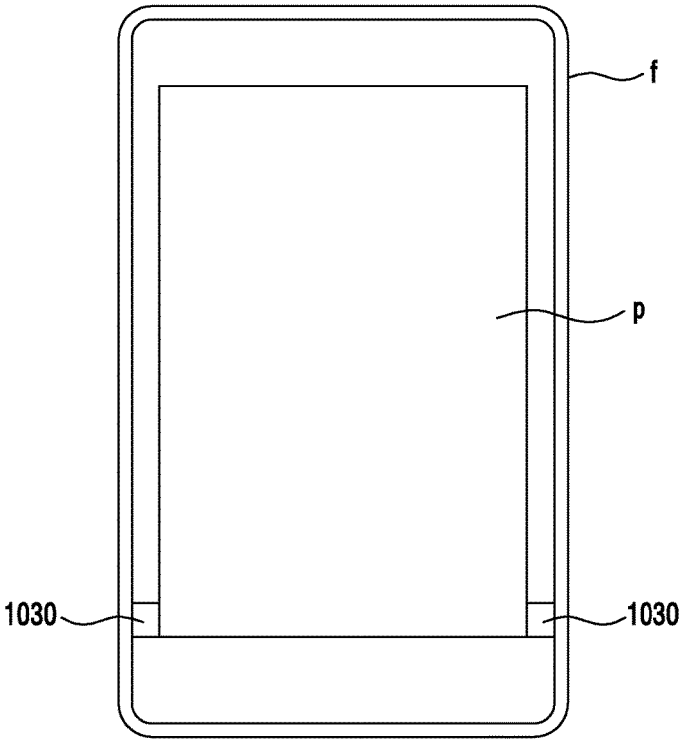
FIG. 32A is a view illustrating a ground structure of a substrate according to various embodiments of the present disclosure.
Figure 32B:
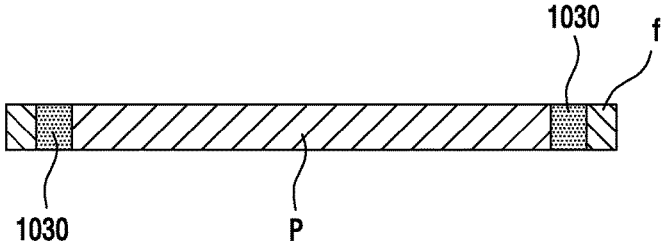
FIG. 32B is a view illustrating a ground structure of a substrate according to various embodiments of the present disclosure.

FIG. 32A is a view illustrating a connection (ground) structure of an external metallic frame according to various embodiments of the present disclosure. FIG. 32B is a view illustrating a connection (ground) structure of an external metallic frame according to various embodiments of the present disclosure.

Referring to FIGS. 32A and 32B, the external metallic frame f provided in the electronic device may be configured in a structure that is connected to the substrate P provided in the electronic device using a component 1030.

A separate ground portion separated from the ground portion of the substrate P may be connected to the external metallic frame for connected to the ground portion of the substrate through a capacitor or the like. With this structure, electric shock can be prevented.

Figure 33A:
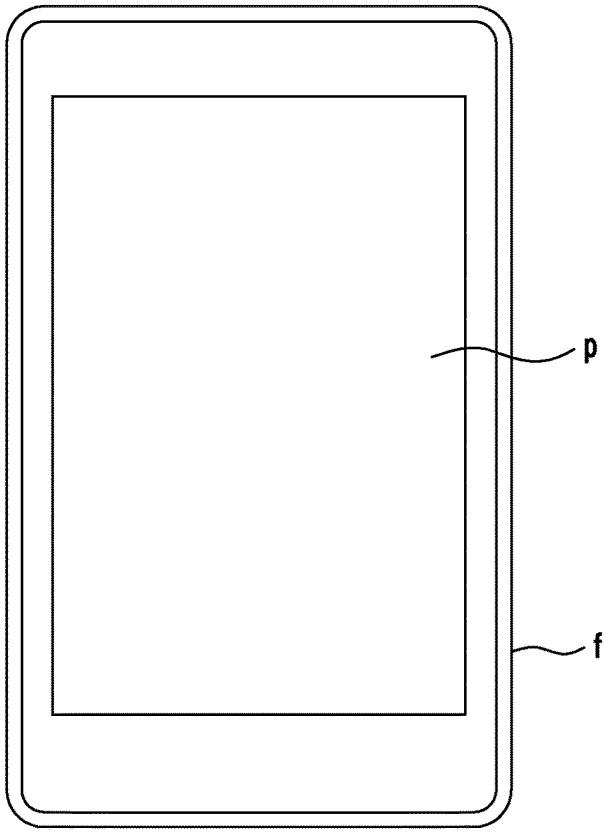
FIG. 33A is a view illustrating a ground structure of a substrate according to various embodiments of the present disclosure.
Figure 33B:
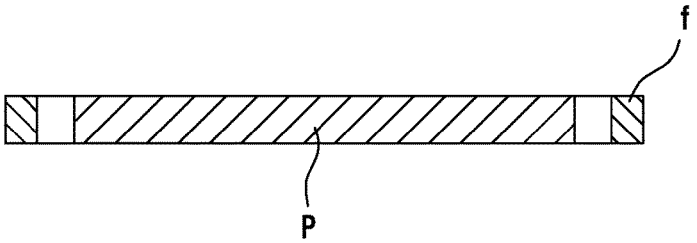
FIG. 33B is a view illustrating a ground structure of a substrate according to various embodiments of the present disclosure.

FIG. 33A is a view illustrating an arrangement (ground) structure of an external metallic frame according to various embodiments of the present disclosure. FIG. 33B is a view illustrating an arrangement (ground) structure of an external metallic frame according to various embodiments of the present disclosure.

Referring to FIGS. 33A and 33B, the external metallic frame f provided in the electronic device may be arranged such that a gap is formed between the external metallic frame f and the substrate P. By the gap, the external metallic frame f may be arranged to be disconnected from the substrate P.

Figure 34A:
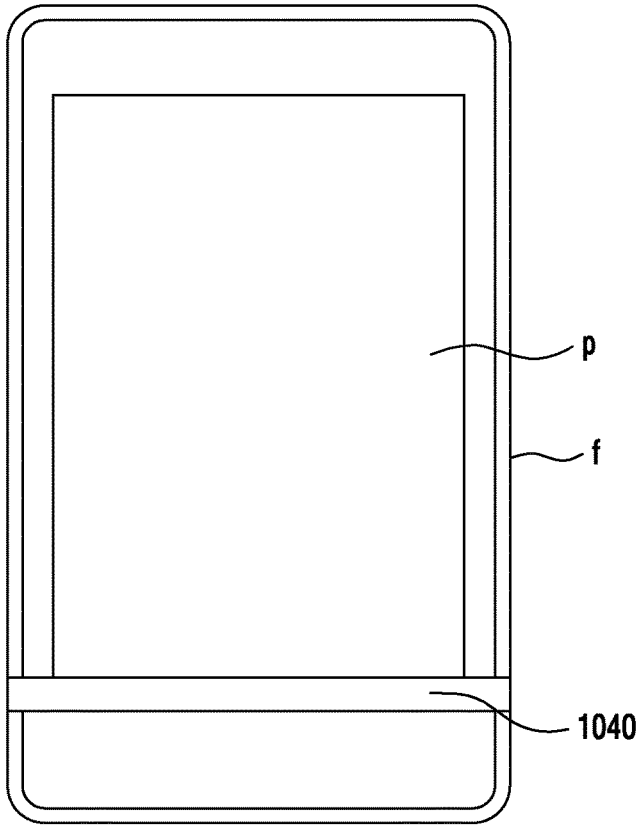
FIG. 34A is a view illustrating a ground structure of a substrate according to various embodiments of the present disclosure.
Figure 34B:
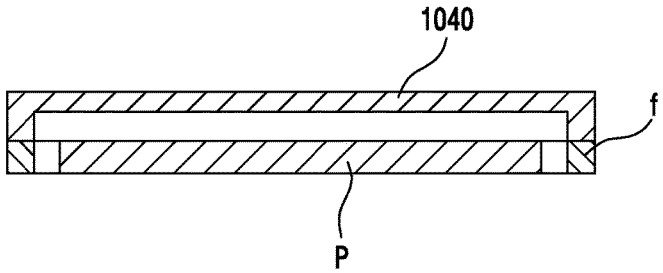
FIG. 34B is a view illustrating a ground structure of a substrate according to various embodiments of the present disclosure.

FIG. 34A is a view illustrating a connection (ground) structure of an external metallic frame according to various embodiments of the present disclosure. FIG. 34B is a view illustrating a connection (ground) structure of an external metallic frame according to various embodiments of the present disclosure.

Referring to FIGS. 34A and 34B, external metallic frames f, which are provided in the electronic device at the opposite side ends, may be interconnected using a cross member 1040. The cross member 1040, which extends across the substrate P while maintaining a gap between the cross member 1040 and the substrate P, may have a specific form or length, and may be implemented in various shapes, thereby removing spurious resonance or a radiation inhibition element. The isolation between the antennas may be increased by the cross member 1040. The cross member 1040 may perform an electric bridge function that connects the external metallic frames f of the opposite sides.

Figure 35A:
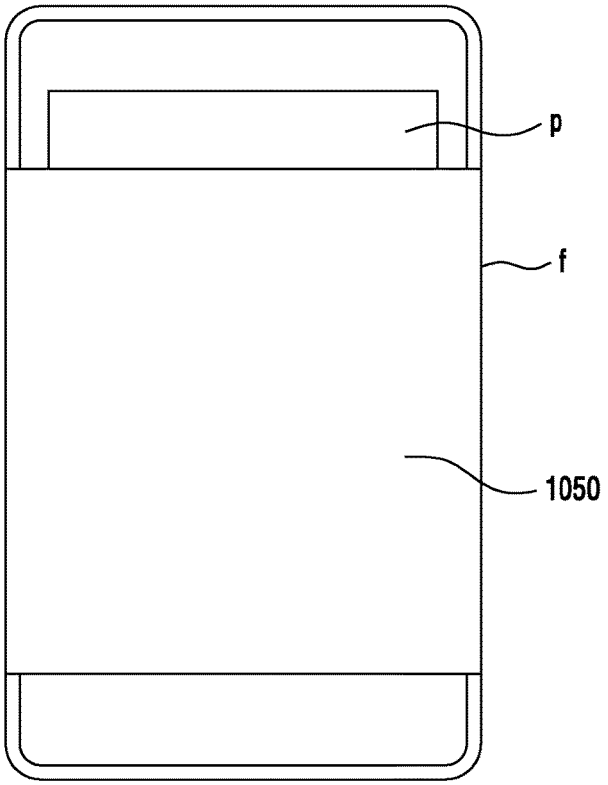
FIG. 35A is a view illustrating a ground structure of a substrate according to various embodiments of the present disclosure.
Figure 35B:
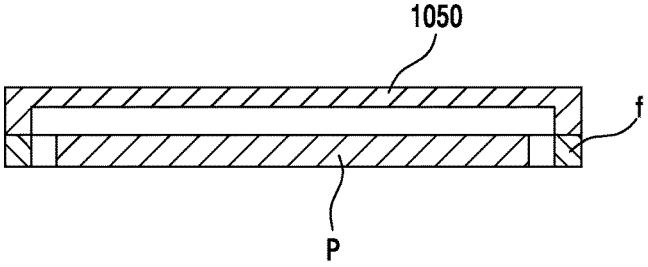
FIG. 35B is a view illustrating a ground structure of a substrate according to various embodiments of the present disclosure.

FIG. 35A is a view illustrating a connection (ground) structure of an external metallic frame according to various embodiments of the present disclosure. FIG. 35B is a view illustrating a connection (ground) structure of an external metallic frame according to various embodiments of the present disclosure.

Referring to FIGS. 35A and 35B, external metallic frames f, which are provided in the electronic device at opposite sides, may be interconnected by a connecting member 1050. The connecting member 1050, which covers at least a portion of the substrate P above the substrate P, may have a specific form or length, and may be implemented in various shapes, thereby removing spurious resonance or a radiation inhibition element. The isolation between the antennas may be increased by the connecting member 1050.

In addition, in order to isolate a plurality of antennas that are arranged in an electronic device, the ground portion of the substrate and the external metallic frame may be connected directly or indirectly between the respective antennas. In addition, in order to isolate the plurality of antennas arranged in the electronic device, a conductive material component, which is connected to the ground portion of the substrate directly or indirectly, may be arranged between the respective antennas or to the ground portion of the substrate.

In addition, the external metallic frames f may be connected with each other by a combination of the cross member 1040 (see FIGS. 34A and 34B) and the connecting member 1050.

The connected antenna radiators may include any one of an inverted F antenna (IFA), a loop antenna, a coupled loop antenna, a patch antenna, a planar inverted F antenna (PIFA), a mono pole antenna, a di-pole antenna, a slot antenna, and a hybrid type antenna.

As described above, according to various embodiments of the present disclosure, there is provided an antenna of an electronic device. The antenna may include a substrate including a ground portion, an external metallic frame of the electronic device, a float ground portion arranged to be connected to the external metallic frame in a state of being disconnected from the substrate, and at least one radiator electrically connected to the float ground portion. Upon being fed with power, the at least one radiator may operate as an antenna radiator, or a section of the external metallic frame may operate as the antenna radiator.

According to various embodiments of the present disclosure, degradation of radiation performance of the antenna is not caused in the electronic device in which a non-segmented external metallic frame is adopted so that electric shock may be prevented.

According to various embodiments of the present disclosure, the at least one radiator may include a main radiator configured to be fed with power by the substrate; and an auxiliary radiator that is conductive with the float ground portion, and operates by being coupled by the main radiator.

According to various embodiments of the present disclosure, the float ground portion may apply a current to the external metallic frame by the operation of the auxiliary radiator.

According to various embodiments of the present disclosure, the external metallic frame may be formed in a non-segmented structure.

According to various embodiments of the present disclosure, the external metallic frame may be configured in a uniform or non-uniform shape.

According to various embodiments of the present disclosure, a conductive material component may be fastened to the float ground portion or the external metallic frame so as to perform a ground function.

According to various embodiments of the present disclosure, the conductive material component may include any one of a USB connector accessary, an earphone connecting jack connector accessary, a camera module accessory, a receiver accessory, and a sensor.

According to various embodiments of the present disclosure, signal lines of the conductive material component may be wired on the substrate across a region in which the float ground portion does not exist, or may be connected along an inner wall of the external metallic frame to be wired on the substrate.

According to various embodiments of the present disclosure, the float ground portion may be made of at least a portion of any one of a rigid substrate, a thin metal plate, and an FCB, and may operate as a radiator.

According to various embodiments of the present disclosure, a plurality of radiators may be provided in the float ground portion to be selectively operated by a power feeding switch.

According to various embodiments of the present disclosure, the float ground portion may be electrically connected to the external metallic frame directly or indirectly.

According to various embodiments of the present disclosure, there is provided an electronic device that may include an internal bracket, a substrate arranged on the internal bracket, an external metallic frame of the electronic device, a float ground portion arranged to be connected to the external metallic frame in a state of being disconnected from the substrate, and at least one radiator electrically connected to the float ground portion. Upon being fed with power, the at least one radiator may operate as an antenna radiator, or a section of the external metallic frame may operate as the antenna radiator.

According to various embodiments of the present disclosure, the internal bracket may be made of a metallic material, an injection molded material, or a combination thereof.

According to various embodiments of the present disclosure, the float ground portion may be connected to the external metallic frame directly or indirectly.

According to various embodiments of the present disclosure, the substrate may be electrically connected to the external metallic frame to be grounded by a metallic fastener.

According to various embodiments of the present disclosure, the substrate may be electrically connected to the external metallic frame via the internal bracket by a metallic fastener.

According to various embodiments of the present disclosure, a specific capacitance may be acquired by adjusting the size of a gap between the external metallic frame and the internal bracket, or an area of faces of the external metallic frame and the internal bracket that face each other.

According to various embodiments of the present disclosure, a fill-cut region may be formed around a hole where the metallic fastener is coupled to the substrate, and an electric device may be arranged in the fill-cut region so that the ground portion of the substrate may be electrically connected to the metallic fastener by an operation of the electric device.

According to various embodiments of the present disclosure, external metallic frames at opposite sides may be interconnected by at least one cross member, a connecting member, or a combination thereof.

According to various embodiments of the present disclosure, the substrate may be grounded to the external metallic frame.

According to various embodiments of the present disclosure, the antenna radiator may include any one of an IFA, a loop antenna, a coupled loop antenna, a patch antenna, a PIFA, a mono pole antenna, a di-pole antenna, a slot antenna, and a hybrid type antenna.

According to various embodiments of the present disclosure, a contact point may not be provided between the internal bracket and the external metallic frame.

According to various embodiments of the present disclosure, in order to isolate a plurality of antennas that are arranged in the electronic device, the ground portion of the substrate and the external metallic frame may be connected directly or indirectly between the respective antennas.

According to various embodiments of the present disclosure, in order to isolate a plurality of antennas that are arranged in the electronic device, a conductive material component, which is connected to the ground portion of the substrate directly or indirectly, may be arranged between the respective antennas.

According to various embodiments of the present disclosure, at least part of the apparatus of the present disclosure may be implemented by using instructions stored in a non-transitory computer-readable storage medium in the form of a programming module. When the instructions are executed by one or more processors, the one or more processors may perform a function corresponding to the instructions. The non-transitory computer-readable storage medium may be a memory, for example. At least part of the programming module may be implemented (for example, executed) by using the processor. At least part of the programming module may include a module, a program, a routine, sets of instructions, a process, and the like for performing one or more functions.

Examples of the non-transitory computer-readable recording medium include magnetic media such as hard disks, floppy disks and magnetic tapes, optical media such as compact disc ROMs (CD-ROMs) and digital versatile discs (DVDs), magneto-optical media such as floptical disks, and hardware devices such as ROMs, RAMs and flash memories that are especially configured to store and execute program commands (for example, the programming module). Examples of the program commands include machine language codes created by a compiler, and high-level language codes that can be executed by a computer by using an interpreter. The above-described hardware devices may be configured to operate as one or more software modules for performing operations of various embodiments of the present disclosure, and vice versa.

A module or programming module according to various embodiments of the present disclosure may include one or more of the above-described elements, may omit some elements, or may further include additional other elements. The operations performed by the module, the programming module, or the other elements according to various embodiments of the present disclosure may be performed serially, in parallel, repeatedly, or heuristically. In addition, some operation may be performed in different order or may omitted, and an additional operation may be added.

While the present disclosure has been shown and described with reference to various embodiments thereof, it will be understood by those skilled in the art that various changes in form and details may be made therein without departing from the spirit and scope of the present disclosure as defined by the appended claims.

What is claimed is:

1. An antenna of an electronic device, the antenna comprising:

a substrate including a ground portion;

an external metallic frame of the electronic device;

a float ground portion arranged to be connected to the external metallic frame in a state of being conductively disconnected from the substrate; and at least one radiator electrically connected to the float ground portion, wherein, upon being fed with power, the at least one radiator operates as an antenna radiator, or a section of the external metallic frame operates as the antenna radiator.

2. The antenna of claim 1, wherein the at least one radiator incudes:

a main radiator configured to be fed with power; and an auxiliary radiator that is conductive with the float ground portion, and operates by being coupled by the main radiator, wherein the float ground portion applies a current to the external metallic frame by the operation of the auxiliary radiator.

3. The antenna of claim 1, wherein the external metallic frame is formed in a non-segmented structure.

4. The antenna of claim 3, wherein the external metallic frame is configured on a rim of the electronic device in a uniform or non-uniform shape, and forms a side rim in a convex shape.

5. The antenna of claim 1, wherein a conductive material component is fastened to the float ground portion or the external metallic frame, and wherein the conductive material component includes any one of a universal serial bus (USB) connector, an earphone connecting jack connector, a camera module, a receiver, and a sensor.

6. The antenna of claim 5, wherein signal lines of the conductive material component are wired on the substrate across a region in which the float ground portion does not exist, or are connected along an inner wall of the external metallic frame to be wired on the substrate.

7. The antenna of claim 1, wherein the float ground portion is made of at least a portion of any one of a rigid substrate, a thin metal plate, and a flexible circuit board, and operates as a radiator.

8. The antenna of claim 1, wherein a plurality of radiators are provided in the float ground portion to be selectively operated by a power feeding switch.

9. The antenna of claim 1, wherein the float ground portion is electrically connected to the external metallic frame directly or indirectly, and wherein the substrate is grounded to the external metallic frame directly or indirectly.

10. An electronic device comprising:

an internal bracket;

a substrate arranged on the internal bracket;

an external metallic frame of the electronic device;

a float ground portion arranged to be connected to the external metallic frame in a state of being conductively disconnected from the substrate; and at least one radiator electrically connected to the float ground portion, wherein, upon being fed with power, the at least one radiator operates as an antenna radiator, or a section of the external metallic frame operates as the antenna radiator.

11. The electronic device of claim 10, wherein the internal bracket is made of a metallic material, an injection molded material, or a combination thereof.

12. The electronic device of claim 10, wherein the float ground portion is connected to the external metallic frame directly or indirectly.

13. The electronic device of claim 10, wherein the substrate is electrically connected to the external metallic frame to be grounded by a metallic fastener.

14. The electronic device of claim 10, wherein the substrate is electrically connected to the external metallic frame via the internal bracket by a metallic fastener.

15. The electronic device of claim 10, wherein a specific capacitance is acquired by adjusting a size of a gap between the external metallic frame and the internal bracket, or an area of faces of the external metallic frame and the internal bracket that face each other.

16. The electronic device of claim 13, wherein a fill-cut region is formed around a hole where the metallic fastener is coupled to the substrate, and an electric device is arranged in the fill-cut region so that the ground portion of the substrate is electrically connected to the metallic fastener by an operation of the electric device.

17. The electronic device of claim 13, wherein external metallic frames at opposite sides are interconnected by at least one cross member, a connecting member, or a combination thereof.

18. The electronic device of claim 10, wherein a contact point is not provided between the internal bracket and the external metallic frame.

19. The electronic device of claim 10, wherein, in order to isolate a plurality of antennas that are arranged in the electronic device, the ground portion of the substrate and the external metallic frame are connected directly or indirectly between the respective antennas.

20. The electronic device of claim 10, wherein, in order to isolate a plurality of antennas that are arranged in the electronic device, a conductive material component, which is connected to the ground portion of the substrate directly or indirectly, is arranged between the respective antennas.

* * * * *